US005566633A

United States Patent [19]

Wesstrom

[11] Patent Number: 5,566,633

[45] Date of Patent: Oct. 22, 1996

[54] SEWING MACHINE WITH TAPE FEED AND PNEUMATIC DEVICES FOR CLAMPING WORKPIECES

[75] Inventor: Martin K. Wesstrom, Wilkes-Barre, Pa.

[73] Assignee: G&G Sewing Machine Company, Inc., Dunmore, Pa.

[21] Appl. No.: 174,551

[22] Filed: Dec. 28, 1993

[51] Int. Cl.[6] ..... D05B 19/16; D05B 35/06; D05B 35/10; D05B 37/04

[52] U.S. Cl. ..... 112/470.03; 112/470.28; 112/152; 112/153; 112/320; 112/DIG. 3; 112/129

[58] Field of Search ..... 112/63, 113, 121.11, 112/121.26, 121.15, 131, 132, 147, 152, 262.1, 305, 311, 314, 313, 322; 83/902, 921, 175, 211, 470.03, 470.02, 470.04, 470.28, 470.31, 470.32, 153, 129, 303, 315, 320, DIG. 2, DIG. 3, 475.03

[56] References Cited

U.S. PATENT DOCUMENTS

| | | | |
|---|---|---|---|
| 2,448,287 | 8/1948 | Abrams | 112/132 |
| 2,773,463 | 12/1956 | Juilie | 112/132 |
| 3,204,591 | 9/1965 | Pickett | 112/147 X |
| 3,954,071 | 5/1976 | Mall et al. | 112/207 |
| 3,994,247 | 11/1976 | Cummins | 112/470.32 |
| 4,067,273 | 1/1978 | Tiarforio | 112/152 X |
| 4,104,977 | 8/1978 | Pollmeir et al. | 112/470.28 |
| 4,258,637 | 3/1981 | Hannemann | 112/470.31 |
| 4,343,254 | 8/1982 | Takatori | 112/475.16 |
| 4,412,498 | 11/1983 | Scholl | 112/313 |
| 4,462,321 | 7/1984 | Mall et al. | 112/470.28 |
| 4,462,530 | 7/1984 | Block et al. | 712/320 X |
| 4,509,443 | 4/1985 | Martell et al. | 112/470.02 |
| 4,550,670 | 11/1985 | Thompson et al. | 112/147 X |
| 4,612,867 | 9/1986 | Rösch et al. | 112/314 |
| 4,635,575 | 1/1987 | Schips | 112/305 X |
| 4,658,741 | 4/1987 | Jehle et al. | 112/131 X |
| 4,777,896 | 10/1988 | Nomura | 112/314 |
| 4,867,082 | 9/1989 | Sabbioni et al. | 112/470.04 |
| 4,867,087 | 9/1989 | Suzuki et al. | 112/314 |
| 4,898,110 | 2/1990 | Nomura et al. | 112/314 |
| 4,920,904 | 5/1990 | Frye | 112/475.01 |
| 4,951,586 | 8/1990 | Becherini | 112/147 |
| 4,967,674 | 11/1990 | Rohr et al. | 112/63 |
| 4,979,450 | 12/1990 | Dudek et al. | 112/113 X |
| 4,998,965 | 3/1991 | Easom | 112/305 |
| 5,014,635 | 5/1991 | Ochi et al. | 112/311 |
| 5,029,543 | 7/1991 | Trojan | 112/152 |
| 5,081,945 | 1/1992 | Bozoglou | 112/470.31 |
| 5,235,923 | 8/1993 | Kojima et al. | 112/322 X |
| 5,277,139 | 1/1994 | Honeycutt | 112/152 X |

*Primary Examiner*—Ismael Izaguirre
*Attorney, Agent, or Firm*—Caesar, Rivise, Bernstein, Cohen & Pokotilow, Ltd.

[57] ABSTRACT

An automatic industrial sewing machine which increases productivity and improves quality in the sewing of linings to facing material in the manufacture of jackets. The machine automatically inserts a plurality of different rates of fullnesses at predetermined locations in the seam between the lining and the facing, for a preset number of stitches for each fullness. It also provides positive feeding for piping sewn into the seam which eliminates stretching or bunching of the piping. Finally, the material is held in position after release of the drag clamp by the use of a jet stream of air impinging on the material. The operation of the machine is automatic in that the operator need only place the facing and lining into the drag clamp and into the air guide and depress a switch. The machine then automatically sews the seam with or without piping, inserting the fullnesses desired in the seam, automatically cutting the piping prior to, and at the end of, the sewing of the seam, and automatically transporting the material to a stacker.

51 Claims, 12 Drawing Sheets

133
73
342
129
131
340
127
70
68
113
134
135
72
112
62
103
7
3
110
64
101
105
10
8
108
6
196
120
117
113
9
57
198
104
115
118
106
119
22
116
114
20
102
103
29
24
26
18
101

FROM STEPPER MOTOR 202
24V
FULLNESS #1 A
FULLNESS #2 B
FULLNESS #3 C
TO 34
TO 36
TO 38
TURN ON DEVICES D
SHUT OFF DEVICES E
STACKER F
DRAG CLAMP RETURN G
THREAD WIPER H
STACKER
AIR PILOT VALVE
AIR PILOT VALVE
TRANSP CYLINDER
AIR INT SWITCH
P.S. 24V
AIR INT SWITCH
DRAG CLAMP RETURN
MATERIAL HOLDER
SENSOR CONTROL
DRAG CLAMP SENSOR
320
326
328
330
329
164
166
406
408
410
226
228
424
426
214
220
332
402
404
334
222
412
230
492
224
414
418
232
416
248
322
27
26

SEWING MACHINE WITH TAPE FEED AND PNEUMATIC DEVICES FOR CLAMPING WORKPIECES

BACKGROUND OF THE INVENTION

This invention relates generally to sewing machines, and in particular to a new and useful apparatus which can be added to existing sewing machines to increase productivity and to improve quality.

For the sewing of seams between linings and facing materials in the manufacture of jackets, novel and basic improvements over existing sewing machines are provided by this machine, including:

1. A plurality of automatic, pneumatically controlled fullnesses with preset rates which are inserted in predetermined segments of the seam.
2. A positive feed system which automatically synchronizes the feed of piping being sewn into seams with the feed of the facing material, to assure evenness and smoothness in the seam with the piping.
3. A pneumatic jet system for holding the material in place during the sewing of the last few stitches of the seam after the drag clamp has been released.

With regard to fullness, as is well known to those in the field, when two dissimilar materials are sewn into a seam such as the lining and facing of a jacket, the speed of the lining material must be increased relative to the speed of the facing material at various segments along the length of the seam to assure that the seam is even and flat. The relative difference in the speeds are referred to as "fullness."

For seams between the facing and lining materials for jackets, the fullness is often incorporated by an operator who manually pulls on the facing material while the seam is being sewn to slow down the speed of the facing material relative to the lining material. This type of operation requires highly skilled operators and often results in the lack of uniformity with regard to the quality of the seams in the jackets.

In some existing sewing machines, such as the 487G, a manual lever is used to set in a fullness. The fullness is actuated by the operation of a foot lever by the operator as the seam is being sewn. This system only allows for a single degree or amount of fullness for the seam. It does not result in the higher quality achieved by varying the fullness along the run of the seam more than once and at different degrees. In addition, the differences in timing between operators in applying the fullness and in the length of the segment to which the fullness is applied, results in varying the quality of the seams produced.

Sewing machines with speed controls which vary the relative speed between the top and bottom feeds to synchronize the speeds, and which use sensors and measuring wheels are disclosed in U.S. Pat. No. 3,954,071 (Mall et al.); U.S. Pat. No. 3,994,247 (Cummins); and U.S. Pat. No. 4,462,530 (Block et al.).

Devices which allow for variable rates of speed between the upper and lower feeds to change fullness are disclosed in U.S. Pat. No. 4,509,443 (Martell et al.) which programs a controller for sewing a seam to connect sleeves so that the operator merely has to feed in types of material and sizes onto a control panel to regulate the speed; U.S. Pat. No. 5,014,635 (Ochi et al.); and U.S. Pat. No. 4,867,082 (Sabbioni et al.) which uses a CPU, i.e., a central processing unit, to control speeds with a programmable microprocessor.

Sewing machines which automatically line up patterns for sewing seams are disclosed in U.S. Pat. No. 4,612,867 (Rösch et al.); U.S. Pat. No. 4,777,896 (Nomura); U.S. Pat. No. 4,867,087 (Suzuki et al.) and U.S. Pat. No. 4,898,110 (Nomura et al.).

Devices for inserting tapes or strips into sewing machines to sew to other material are disclosed in U.S. Pat. No. 4,951,586 (Becherini); U.S. Pat. No. 4,920,904 (Frye); U.S. Pat. No. 5,081,945 (Bozoglou); U.S. Pat. No. 4,998,965 (Easom); and U.S. Pat. No. 4,967,674 (Rohr et al.).

Various drag clamp devices are disclosed in U.S. Pat. No. 4,462,321 (Mall et al.) which discloses two drag clamps spaced laterally, the laterally spaced clamp holding a material in place after the first clamp releases; U.S. Pat. No. 4,258,637 (Hannemann) which discloses a pneumatically actuatable clamp; and U.S. Pat. No. 4,104,977 (Pollmeier et al.) which has a fixed clamp and a trailing clamp which are compressed-air operated.

U.S. Pat. No. 4,412,498 (Scholl) describes a differential feed device wherein the feed mechanisms are pneumatically controlled.

There is a need for a sewing machine which provides for greater automaticity and more uniform, higher quality in the sewing of seams between the lining and facing of jackets as does the machine of this invention. The sewing machine disclosed herein provides for approximately a 2.2 times increase in productivity in the sewing of jacket seams and a 3.2 times increase in the sewing of jacket seams with piping over existing machines. In addition to the productivity increases, an approximate 25% decrease in production rejects and lower quality seams is achieved.

OBJECTS OF THE INVENTION

Accordingly, it is the general object of the instant invention to provide a sewing machine for stitching two materials together at a seam which overcomes the limitations of, and improves upon, the prior art.

It is a further object of the instant invention to provide a sewing machine for stitching two materials together at a seam which allows for the automatic insertion of a plurality of fullnesses in the materials for preselected segments of the seam.

It is yet a further object of the instant invention to provide a sewing machine for sewing two materials together at a seam which automatically incorporates a folded tape or piping into the seam.

It is still yet a further object of the instant invention to provide a sewing machine for sewing two materials together at a seam which provides for a positive feed for the piping incorporated into the seam.

It is another object of the instant invention to provide a sewing machine for sewing two materials together at a seam, which includes a means for holding the materials in position for the final stitching operation after the drag clamp has been released.

It is still another object of the instant invention to provide a sewing machine for sewing two materials together at a seam which has a means for automatically cutting the piping prior to and after sewing has been completed.

It is still yet another object of the instant invention to provide a sewing machine for sewing two materials together at a seam, which has means for feeding the material beneath the cutter and into a stacker, after the stitching operation has been completed.

It is an additional object of the instant invention to provide a sewing machine for sewing two materials together at a seam which has a means for automatically returning the drag clamp to its initial position after the drag clamp has been released.

It is still yet an additional object of the instant invention to provide a sewing machine for sewing together two materials at a seam which has a means for automatically aligning the edges of the materials prior to their insertion under the foot of the machine.

SUMMARY OF THE INVENTION

These and other objects of the instant invention are achieved by providing a sewing machine for sewing two materials together at a seam which enables the automatic setting and incorporation of a plurality of fullnesses at various segments of the seam in addition to the single fullness setting incorporated in a standard machine. Various pneumatically operated components are added to a standard machine to provide the fullnesses, and to provide a forced air means of holding the material properly in place for the last few (10–20) stitches after the drag clamp has been released. In addition, a motor driven pulley system to automatically position the drag clamp at its starting point after the drag clamp has been released and a motor driven means to positively feed piping or tape into the machine at a speed which is synchronized with the lower feed mechanism of the machine are incorporated.

These features are automatically set in and controlled by electronic controls and pneumatic controls. The system results in a considerable increase in quality and in productivity on the part of the operator, who need only position the material and depress a start pedal to initiate the automatic process. The machine sews the seam at the required degrees of fullness, incorporates piping into the seam if desired, cuts the tape, moves the material to a stacker, and returns the drag clamp to its starting position without further intervention by the operator.

DESCRIPTION OF THE DRAWINGS

Other objects and many of the intended advantages of this invention will be readily appreciated when the same becomes better understood by reference to the following detailed description when considered in connection with the accompanying drawings, wherein.

DETAILED DESCRIPTION OF THE PREFERRED EMBODIMENTS

Figure 1:
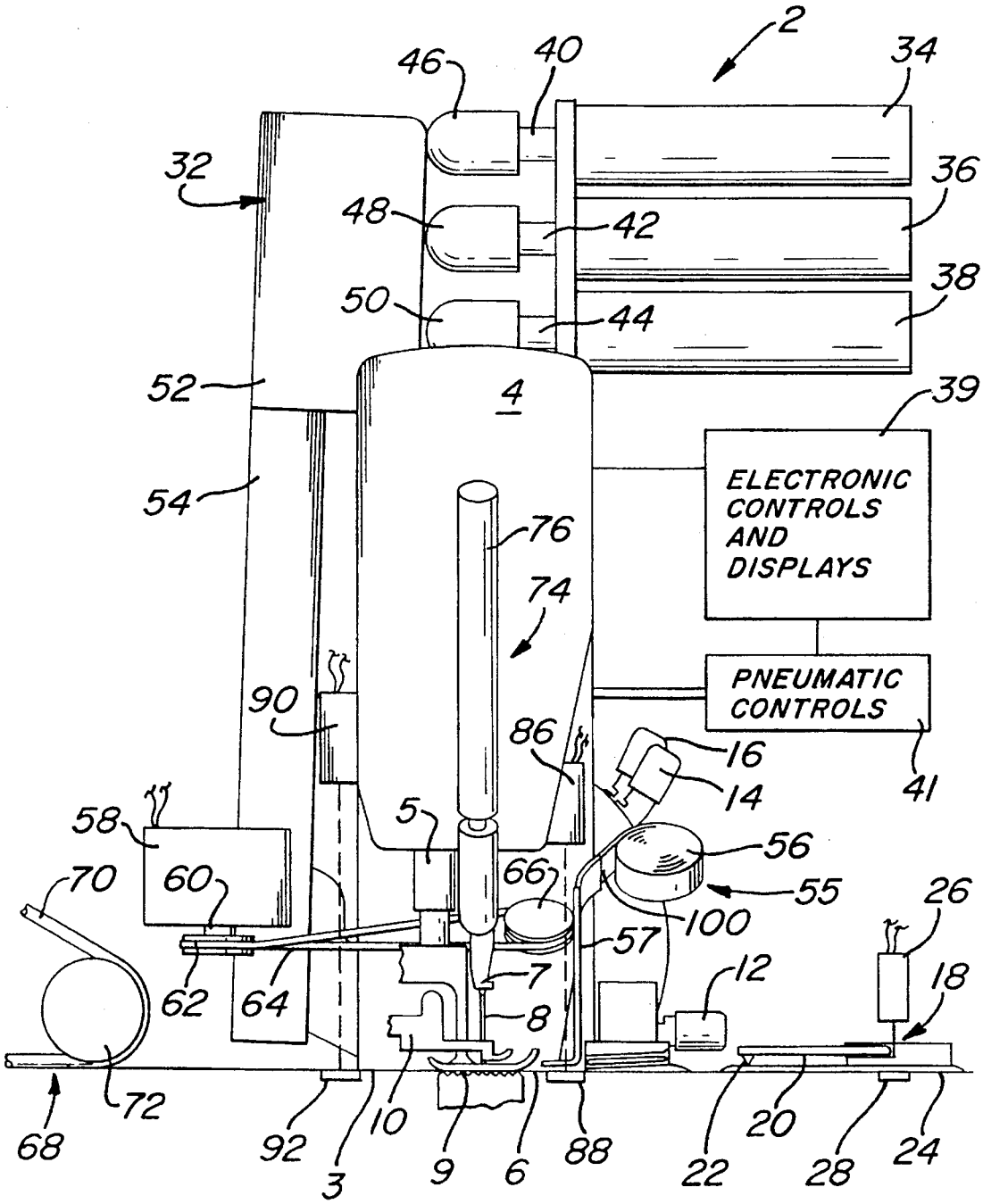
FIG. 1 is a block representation of the sewing machine, showing the standard sewing machine.

Referring now in greater detail to the various figures of the drawings, wherein like reference characters refer to like parts, the sewing machine 2 of the instant invention is shown in FIG. 1. As can be seen in the figure, the standard parts of the sewing machine 2 include a base 3, a head 4, a foot 6, a needle bar 7, a needle 8, a lower feed mechanism 9, and an upper feed mechanism 10. The standard machine also includes three manually set levers 12, 14 and 16. The position of the manual lever 12 determines the number of stitches per inch which the machine will provide in sewing of the seam. The position of the center manual lever 14 provides a starting point with regard to fullness. Depending on the type of thread and the types of material, the manual lever 14 can be set at the same setting as the manual lever 12 to provide zero fullness, it can be set slightly above the manual lever 12 to provide a slight positive fullness, or it can be set slightly below the setting of the manual lever 12 to provide a slight negative fullness. Manual lever 16 provides a single fullness setting which will provide fullness for the material controlled by the upper feed mechanism under the manual control of the machine operator, as will be explained in detail later.

A drag clamp assembly 18 which has an arm 20 and a pin 22 attached to one end of the arm 20, is used to hold the material in position during the sewing of the seam. The clamp operates when the pin 22 presses down on the material which is placed on the base 24. A drag clamp sensor 26, and a reflector 28 are used to initiate the operation of an air cylinder with pulleys and a cord which returns the drag clamp assembly to its initial starting point after the drag clamp assembly 18 has been released. The drag clamp sensor 26, as well as the other sensors in this system comprise electric eyes which project a beam which impinges on a reflector. The return beam is received by a receiver in the sensor which provides a signal to an electrical control means, as will be explained in detail later.

The automatic fullness system 32 provides a means for incorporating a plurality of fullnesses for each segment of the seam. It comprises a plurality of pneumatic cylinders 34, 36 and 38 which respectively have pistons 40, 42 and 44, to which respective piston heads 46, 48 and 50 are attached. The fullness system also comprises a lever block 52 attached to a lever arm 54. When a pneumatic cylinder is activated, its associated piston head impinges upon the lever block 52 causing the lever arm 54 to rotate about a pivot. The amount of movement of the lever arm 54 determines the degree of fullness, i.e., the ratio between the speed of the material fed through the upper feed mechanism 10 and the speed of the material fed through the lower feed mechanism, as will be explained in detail later.

Hereinafter, the material controlled by the lower feed mechanism 9 will be referred to as the facing, and the material controlled by the upper feed mechanism 10 will be referred to as the lining, although it should be understood that any type of material can be used.

The piping or ribbon feed system 55 uses a piping 100 on a roll 56. The piping feed system 55 comprises a chute 57, a stepper motor 58 with a shaft 60, a pulley drum 62, a pulley drum 66 and a belt 64 positioned in the grooves of the pulley drums 62 and 66. The piping 100 is threaded into the chute 57 and is then positively fed through the chute 57 on top of the facing being controlled by the lower feed mechanism 9.

The belt 64 abuts with the inner surface of the chute 57 which has a slit cut therein (not shown). As the belt 64 moves, it presses down upon and moves the piping 100. As will be explained later, the stepper motor 58 is synchronized with the speed of the machine 2 and the lower feed mechanism 9. Thus, a positive movement of the piping into the seam is achieved. This eliminates unevenness due to bunching or stretching caused by the nature or elasticity of the piping material when the piping is pulled by the lower feed mechanism instead of this mechanism which positively feeds the piping.

Also shown in FIG. 1 is a partial view of a transporter 68 which comprises a transporter belt 70 positioned in a pulley drum 72 to move the material, after the sewing of the seam has been completed, to transport the material to the cutter and to a stacker.

In addition to the drag clamp sensor 26 which is used to initiate the automatic return of the drag clamp 18 to its starting position, two other sensors (electric eyes) 86 and 90 are incorporated into the machine. Material sensor 86 which impinges a beam upon a reflector 88 in the base 3 of the sewing machine 2 is used to indicate the trailing edge of the material as the seam is being sewn. A cutter sensor 90 with a reflector 92 in the base 3 indicates the end of the material. When the sensor 90 receives the reflector light beam from the reflector 92, it provides a signal for lowering the transporter 68, to move the material a specified distance to the stacker. In addition, the signal from the sensor 90 signifying the end of the material is sent to the electronic controls 39 which insert a delay (i.e., an additional stitch count) before generating a signal to operate the cutter. The piping 100 is also cut at the start of the stitching. The cutting of the piping 100 at the start of the stitching and at the end of the stitching will be explained in detail later.

Figure 2:
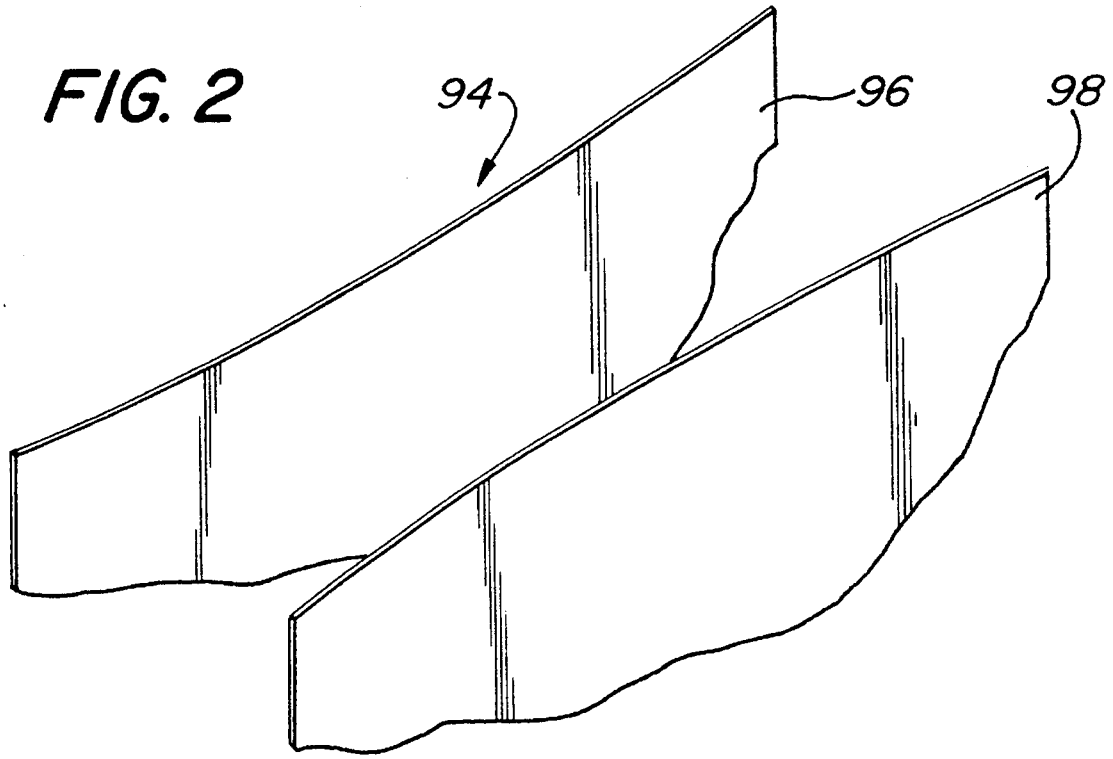
FIG. 2 shows the two materials to be sewn together at the seam.
Figure 3:
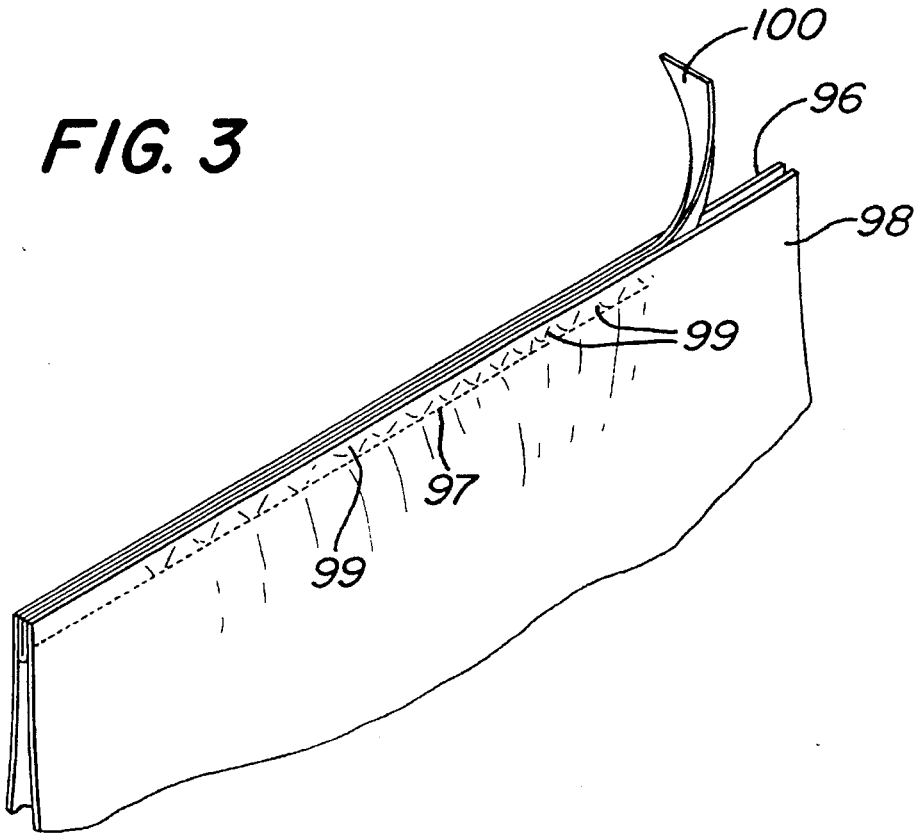
FIG. 3 shows the partially sewn seam with the folded piping being incorporated in the seam.

Referring now to FIGS. 2 and 3, the material 94 comprises a facing 96 and a lining 98 to be sewn together at a seam 97. As mentioned previously, the lining 98 requires fullness or bunching with respect to the facing 94 so that the seam may lie properly when the garment is worn.

FIG. 3 shows a partially sewn seam showing the fullness 99 between the facing 96 and the lining 98 and the folded piping 100 which is being incorporated into the seam. The fullness 99 is incorporated by increasing the feed speed of the lining with respect to the facing as the stitching is made, as will be explained in detail later.

Figure 5:
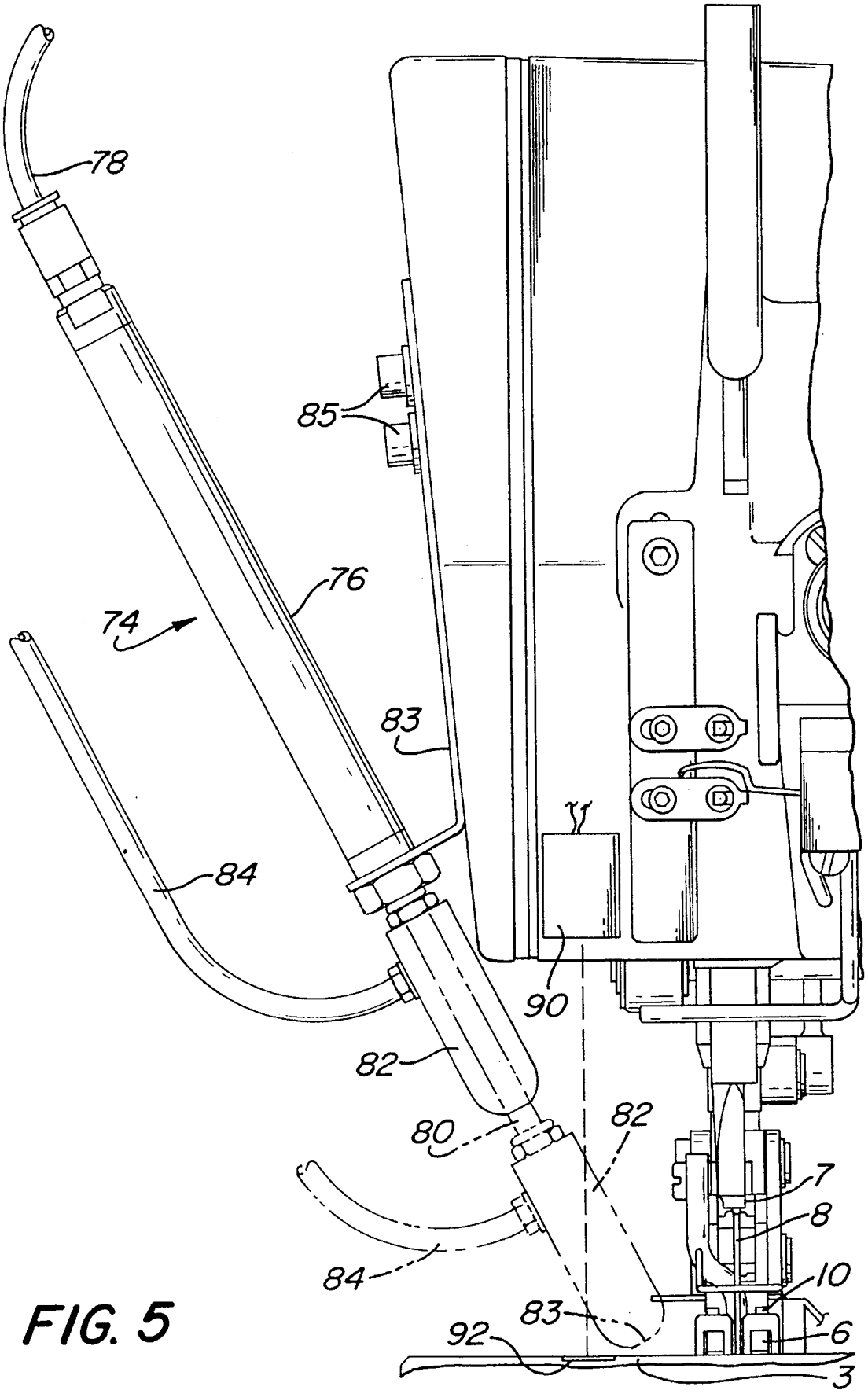
FIG. 5 is a partial view of the right side of the machine showing the pneumatic system used to maintain the position of the material for sewing the final stitches of the seam after the drag clamp has been released.

Referring to FIG. 5, the material holding mechanism 74 will now be explained. The purpose of the material holding mechanism 74 is to provide a positive force on the material 94 to hold the material in place under the machine after the drag clamp 18 has been released. The material holding mechanism comprises a pneumatic cylinder 76, with an attached air line 78 and a piston 80. Attached to the piston 80 is a hollow piston head 82 to which an air line 84 is attached. Upon release of the drag clamp 18, compressed air is fed from the air line 78 into the pneumatic cylinder 76. This causes the piston 80 in the pneumatic cylinder 76 to move forward as shown by the dashed lines. When the piston head 82 is positioned close to the material (as shown by the dashed lines) a jet of compressed air is fed through the air line 84 into the piston head 82 and through an opening 83, thereby impinging upon the material and holding the material in place after the drag clamp has been released. The material holding mechanism is mounted on the side of the sewing machine 2 by a bracket 83 secured to the machine by butts 85.

Figure 4:
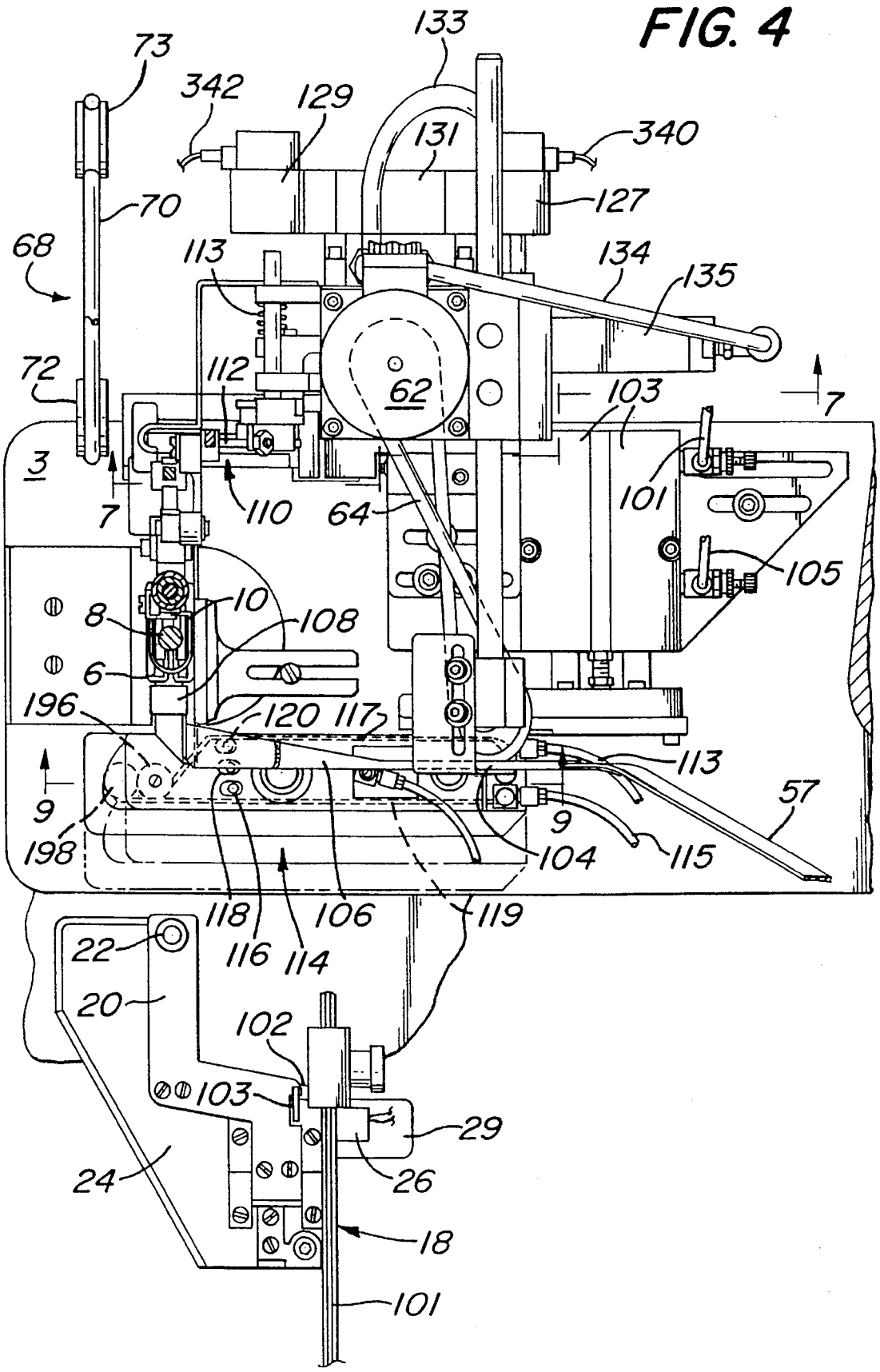
FIG. 4 is a plan view of the machine taken above the base of the machine, the table upon which the machine is mounted and the drag clamp used with the machine.

The details of the drag clamp assembly 18 are shown in FIG. 4. The drag clamp assembly 18 comprises the arm 20 and the pin 22 which clamps the material between itself and the base 24 as previously explained. At the start of the operation, one end of the lining 98 and the facing 96 is placed on the base 24 and the arm 20 is pressed downward which clamps the material between the pin 22 and the base 24. A spring mechanism (not shown) retains the drag clamp assembly 18 in the clamping position. The drag clamp assembly 18 also comprises a rail 101, a release member 103, and a release pin 102. When the drag clamp assembly 18 reaches the end of its travel on the rail 101, the release member 103 contacts the release pin 102, releasing the clamp and allowing the material to continue to move toward the foot of the sewing machine.

The drag clamp sensor 26 is mounted on the rail and the reflector 28 is mounted beneath the drag clamp assembly as was shown in FIG. 1. A blocking tab 29 is mounted on the drag clamp assembly 18 so that when the blocking tab 29 passes between the drag clamp sensor 26 and the reflector 28, the return beam of the sensor 26 is blocked. The sensor 26 also includes a sensor control unit 27 (not shown) which will be explained later. The blocking of the beam between the drag clamp sensor 26 and the reflector 28 causes the sensor control unit 27 to provide a contact closure to the electronic control means 39. The electronic control means 39 produces a signal which operates a pneumatic cylinder (not shown), to which a pulley is attached with a cord, which pulls the drag clamp assembly 18 back on the rail 101 to its initial starting position. In addition, as will be explained later, the contact closure from the control unit 27 initiates three other functions (see FIG. 11). It operates the material holding mechanism 74, the transporter 68 and resets fullness cylinders 34, 36 and 38 back to their initial (zero) positions.

Also shown in FIG. 4 is the chute 57 which has a feed segment 104, a folding segment 106 and an end segment 108. As previously stated, the belt 64 impinges upon the piping 100 to positively feed the piping through the chute 57. The folding segment 106 automatically folds the piping and directs it to the end segment 108. Thus, the piping is positively fed directly beneath the foot 6 above the facing 96. As stated previously, the motor 58 which drives the belt 64 is synchronized with the speed of the lower feed mechanism by the electronic control means 39 assuring that the piping is fed into the seam evenly and without pulling or stretching.

Cutter mechanism 110 comprises a cutter blade 112 which automatically cuts the piping before and after the stitching has been completed. The cutter mechanism 110 is operated by solenoids 127 and 129, connected to an air pilot valve 131. The output of the air pilot valve 131 is connected to air cylinder 135 by air lines 133 and 134. The application of 24 Volts DC to line 340 by the electronic control means 39 activates the solenoid 127, providing compressed air, via the air pilot valve 131 and the air line 134, into air cylinder 135 driving the piston of air cylinder 135 forward (to the left)

and causing the blade 112 to cut the piping 100. Similarly, the application of 24 Volts DC to line 342 activates the solenoid 129, providing compressed air, via the air pilot valve 131 and the air line 133, to the air cylinder 135, driving the piston of the air cylinder back (to the right) which also causes the block 112 to cut the piping 100. The reciprocating motion of the cutter mechanism 110 to cut the piping at the start of the stitching and at the end of the stitching will be described later. The action of the cutter mechanism is initiated when the sensor 90 detects the end of the material. The sensor 90 sends a signal (contact closure) to the electronic control means 39, which provides voltage to the solenoids 127 and 129, via lines 340 and 342 at the proper time and in the proper sequence.

An air guide 114, used to position the edges of the facing 96 and lining 98 for the sewing of the seam comprises guide posts 116, 118 and 120, air lines 113 and 115, air channels 117 and 119 and vents 196 and 198. The air guide 114 includes dual air cylinders 103, connected to air lines 101 and 105, which position the guide from its rest position (shown with dashed lines) and its active position (shown with solid lines). Compressed air via air line 101 moves the piston of cylinders 103 forward to place the air guide 114 in its rest position and compressed air via air line 105 returns the pistons to their rearward positions moving the air guide 114 to its active position. The control system for operating air guide 114 will be described in detail later.

The air guide blows air over the material and toward the guide posts 116, 118 and 120 so that the edges of the material of the facing 96 and the lining 98 line up with the guide posts which puts the material in the proper position for the sewing of the seam. The forced air is fed into the air channel 117 via the air line 113 into the vent 196 for impinging air upon the lining and through the air channel 119 via the air line 115 to a vent 198 for impinging upon the facing.

Figure 6:
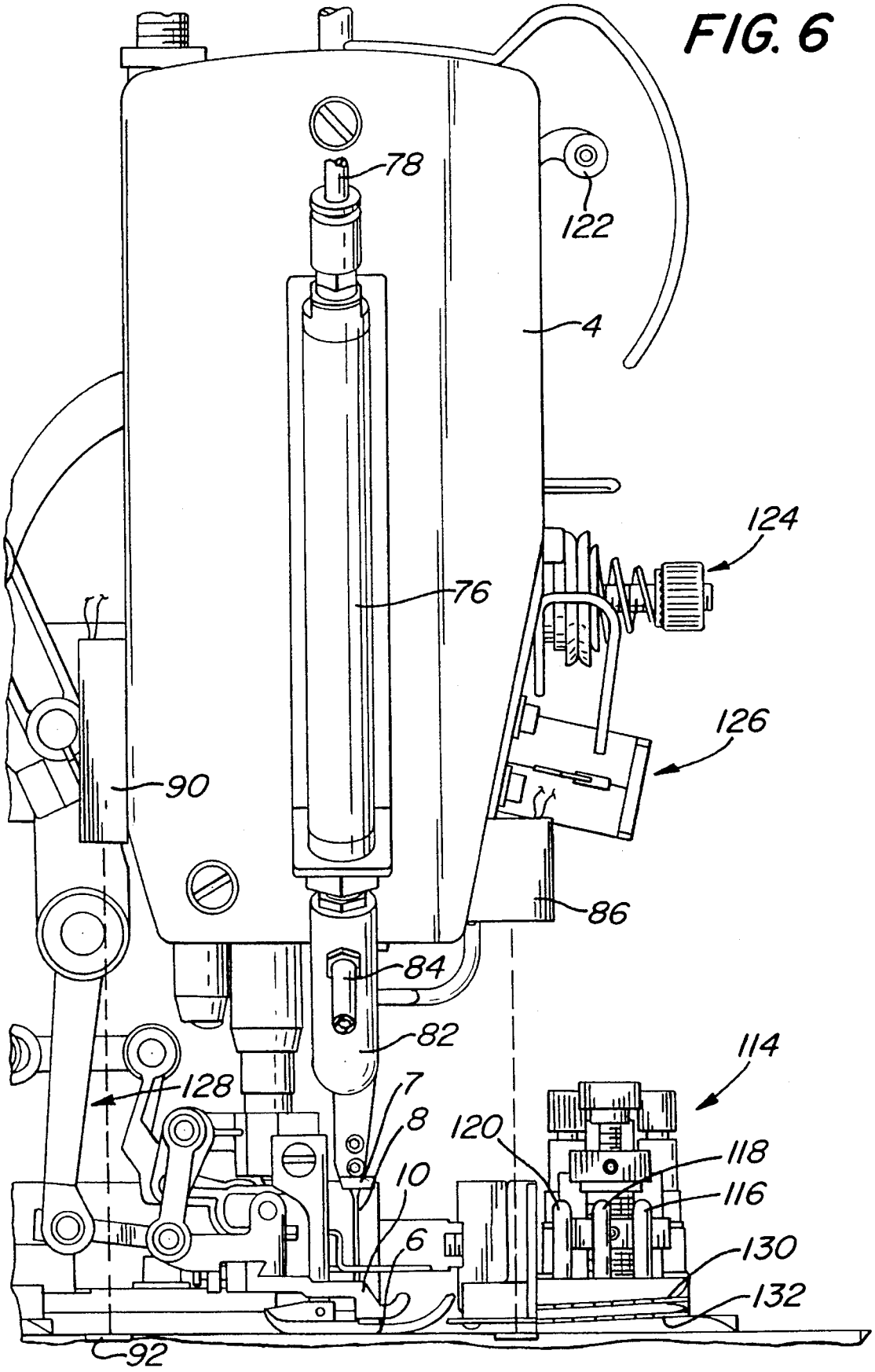
FIG. 6 is a front view of the machine showing the foot, the upper feed mechanism, and the linkage which positions the upper foot to control fullness.

FIG. 6 is a front view of the sewing machine 2. Several of the standard parts of the machine such as the slack thread regulator 122, the thread tension assembly 124, and the top thread monitor 126, attached to the head 4 of the machine, are shown. The air guide 114 is also shown, partially in section. The guideposts 116, 118 and 120 are used to position the edges of the material for sewing in the seam as previously explained. The lining 98 is placed by the operator in an upper feed channel 130 so that it is positioned to be fed by the upper feed mechanism 10, and the facing 96 is placed in a lower feed channel 132 so that it is positioned to move under the foot 6 and be controlled by the lower feed mechanism 9. Also shown in the figure is the linkage 128 which controls the movement of the upper feed mechanism 10. This linkage is standard with the machine. The upper feed lever 10 reciprocates forward, then back, as the material moves through the sewing machine. When the upper feed mechanism 10 is in its forward position, it presses down upon the lining and moves it forward producing fullness with relation to the facing 96. The larger the movement forward of the upper feed mechanism 10, the greater the amount of fullness that is obtained.

Figure 7:
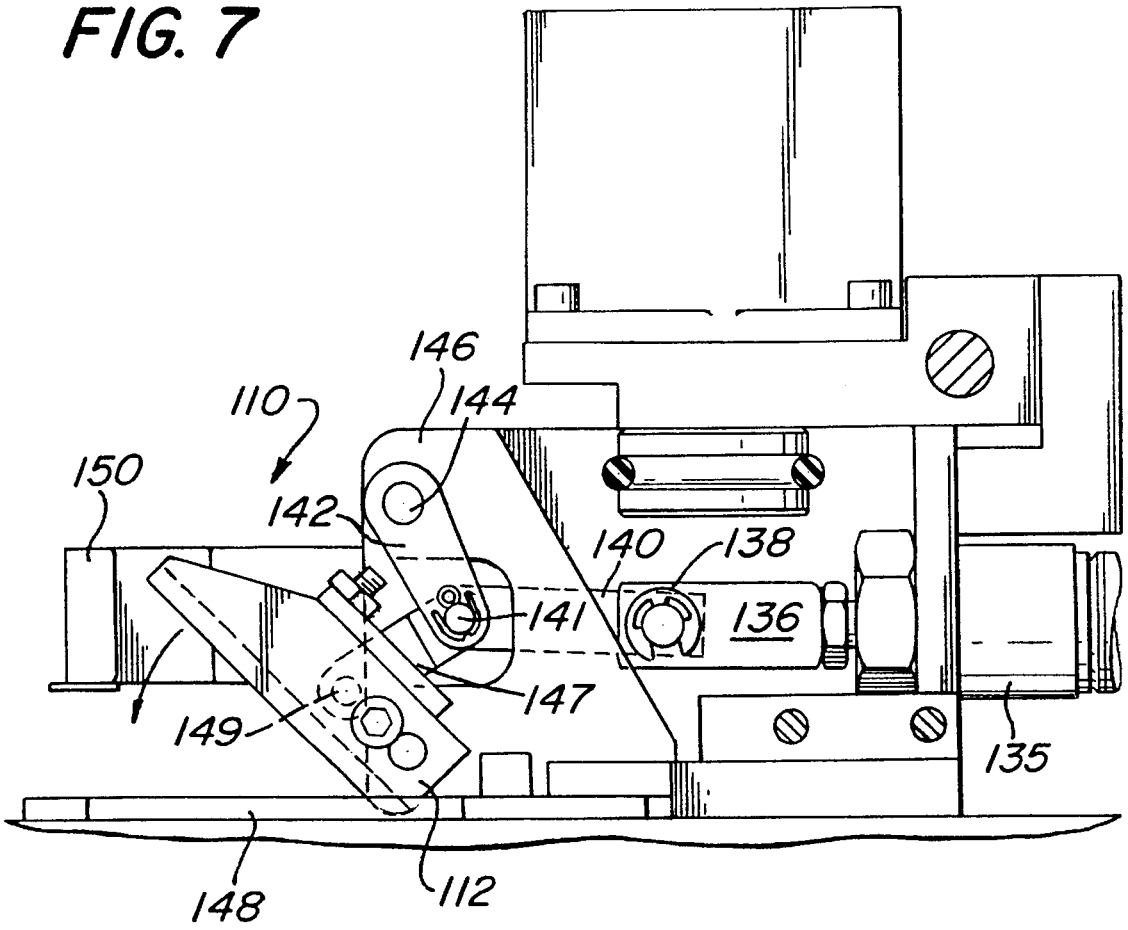
FIG. 7 is a side view of the automatic mechanism for cutting the piping or tape.

The operation of the cutter mechanism 110, which cuts the piping before and after the sewing operation of the seam, will now be explained. Referring to FIG. 7, air cylinder 135 comprises a piston head 136 which is coupled to an arm 140 by pivot 138. The other end of the arm 140 is pivotably coupled to links 142 and 147 via pivot 141. The other end of link 142 is pivotably connected to a wall 146 via a pivot 144 and the other end of link 147 is pivotably coupled to the blade 112 via a pivot 149. When compressed air is fed into cylinder 135, the piston head 136 moves forward which causes arm 140 to move forward. This causes the link 142 to rotate clockwise about the pivot 144. The link 147 then rotates counterclockwise about the pivot 149, moving the blade 112 downward in the direction of the arrow. The cutter blade 112 moves into a slit 148 in the base of the machine. This provides a scissor action which cuts the piping.

The cutter mechanism 110 includes guard 150 which provides protection against injury when the cutter mechanism is in use. The mechanism is a double-acting mechanism in that the pivot 141 goes past the vertical, causing the blade 112 to move upward into its initial rest position. Upon retraction of the piston head 136 and the arm 140, the pivot 141 moves back which lowers the blade 112 to cut the piping and again retracts the blade 112 to its initial rest position.

Figure 8:
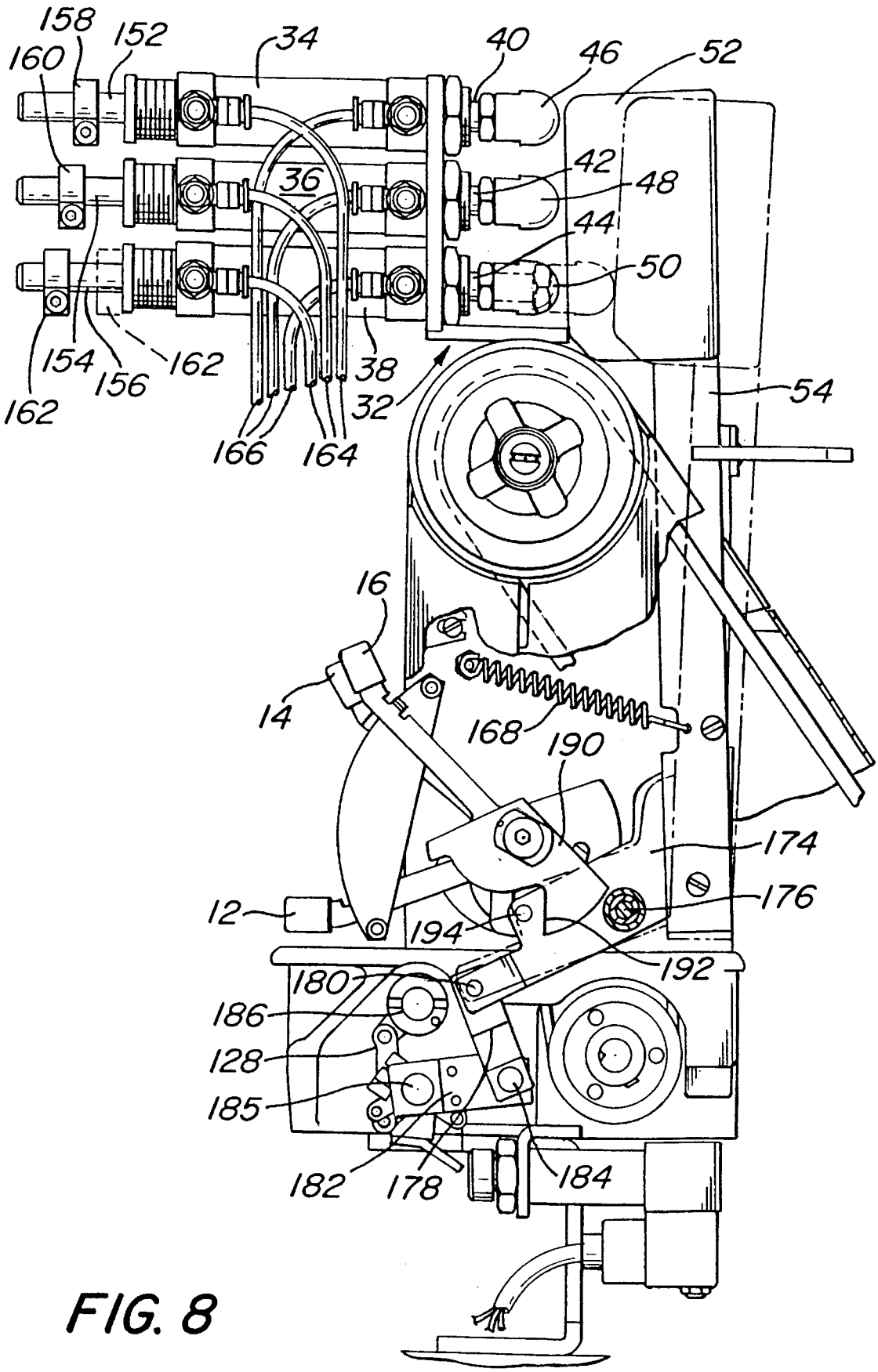
FIG. 8 is a side view, partially in section, of the pneumatic system for varying the fullness of each segment of the seam.

The detailed operation of the pneumatic system for providing fullnesses for each segment of the seam will now be described. Referring to FIG. 8, the three pneumatic cylinders 34, 36 and 38, with the pistons 40, 42 and 44, respectively, are shown. Each of the pistons 40, 42 and 44 has an associated piston head 46, 48 and 50, respectively, which when operated, impinges upon the lever block 52. The pistons 40, 42 and 44, have piston extension 152, 154 and 156, respectively, which extend through the rear sections of the cylinders 34, 36 and 38. Attached to each of the piston extensions 152, 154 and 156 is a limit stop ring 158, 160 and 162, respectively. These limit stop rings are set and locked into position manually. They limit the amount of forward movement of the piston heads 46, 48 and 50 when the pistons are thrust forward. Thus, the closer the limit stop ring is to its associated cylinder, the less the forward movement of its associated piston head and the less the fullness applied to that segment of the seam controlled by the cylinder.

For the settings shown, the first fullness set by limit stop ring 158 is less than the second fullness set by limit stop ring 160, which is in turn less than the third fullness set by limit stop ring 162.

As will be explained in detail later, the number of stitches for each fullness is manually inserted, or automatically inserted via a program disc into the electronic controls. As the seam is stitched, the electronic controls 39 keep track of the number of stitches sewn. For the first fullness, it automatically fires the cylinder 34 at the beginning of the stitch count for the segment of the seam by applying compressed air to the associated air line 164 impelling the piston 40 and its piston head 46 forward against the lever block 52, until the piston is stopped by the limit stop ring 158.

The second fullness is obtained by firing the second cylinder 36 via its associated air line 164 to impel the piston 42 and its piston head 48 further forward against the lever block 52. Similarly, to apply the third fullness, the electronic controls 39 send a signal to apply compressed air to the cylinder 38, thereby thrusting the piston 44 and its associated piston head 50 forward up to the limit set by the limit stop ring 162.

The fullnesses can be applied in any order under the control of the electronic controls 39.

As shown in FIG. 8, the forward motion of the piston 44 and the piston head 50 up to the limit allowed by the positioning of the limit stop ring 162 is shown in dashed lines. Also, the initial position of the piston of the lever block 52 and the lever 54 is shown in solid lines prior to the forward movement of the piston heads 46, 48 or 50 and shown in dashed lines when the piston head 50 impinges upon the lever block 52, to apply the third fullness. At the conclusion of the sewing cycle, the pistons 40, 42, and 44 are reset to their initial retracted positions through the application of compressed air through air lines 166 which drives each of the pistons back.

The greater the forward movement of the piston heads 46, 48 and 50, the more the fullnesses applied to the lining visa vis the facing material. The linkage for controlling fullness is coupled to the lever 54. The linkage comprises a pivot arm 174, links 178 and 182 and pivots 176, 180, 184 and 185. As can be seen in FIG. 8, the movement of the lever 54 causes the pivot arm 174 to move back to a position shown with the dashed lines by rotation about pivot 176. The link 178 is connected to the pivot arm 174 via the pivot 180. When the pivot arm 174 moves back, the link 178 rotates clockwise about the pivot 184. The link 182 is connected to the pivot 184. The link 182 therefore rotates about the pivot 185. This rotational action causes the upper feed mechanism to move forward through the linkage system 188 which is provided with a standard sewing machine and which connects to the upper feed mechanism 10. Thus, the greater the movement of the pivot block 52, the greater the movement of the arm 182 which leads to a larger oscillatory movement of the upper feed mechanism 10 and more fullness.

Also shown on the machine is an initial connection 186 which is connected to a pedal operated by the operator with the standard system and machine. When this manual system is used, depressing of the pedal by the operator causes linkage 188 to operate, which in turn provides rotational motion to links 182 and 178 and to pivot arm 174.

The setting of the manual lever 16 positions a follower 190 which has a cam surface 192. A pin 194 is emplaced on the pivot arm 174. When the operator depresses the pedal attached to connection 186, the pivot arm 174 moves until the pin 194 contacts the cam surface 192 to provide the degree of fullness which has been set manually by the manual lever 16. However, with the addition of the automatic pneumatic setting of fullnesses as provided by this invention, the connection 186 to a pedal for the operator is not used. The system also has a spring 168 which biases the lever arm 54 and the lever block 52 forward to a rest position when the cylinders 34, 36 and 38 are not in use.

Although in the embodiment shown the fullness amount for Fullness #3 is controlled by the setting of the limit stop ring 162, alternatively Fullness #3 can be set by the positioning of manual lever 16 instead of use of the limit stop ring 162.

Figure 9:
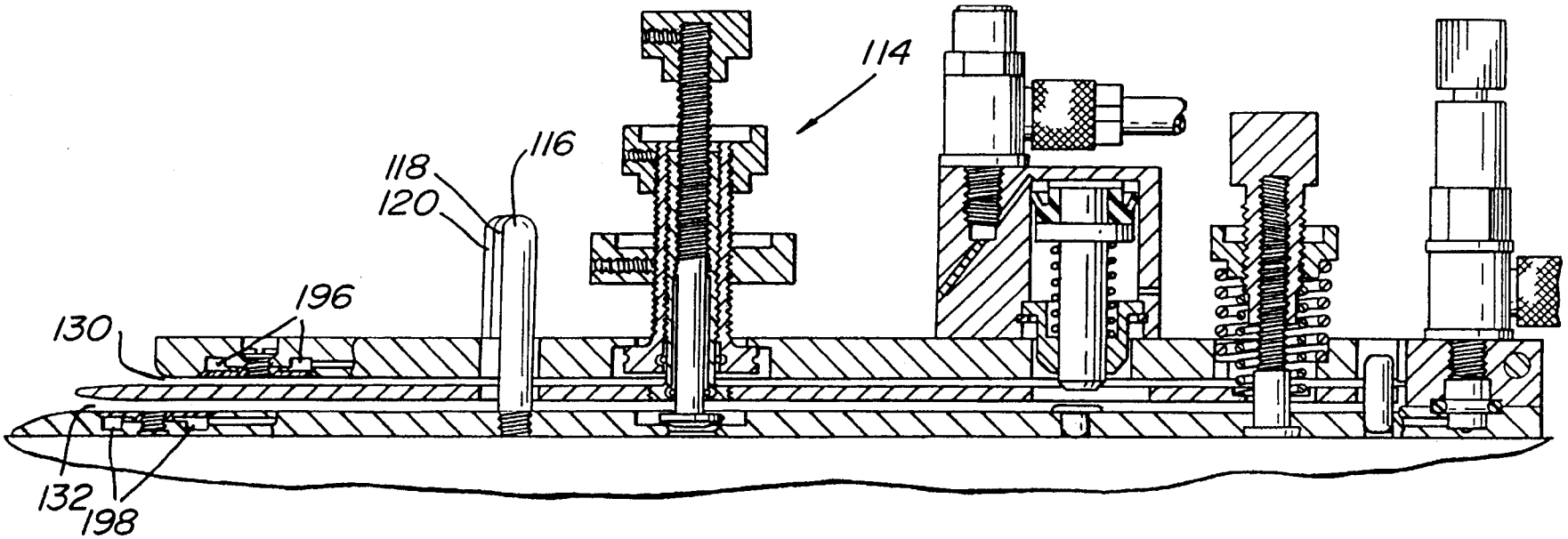
FIG. 9 is a side view, partially in section, of the air guide used to position the edges of the material prior to sewing the seam.

FIG. 9 shows a sectional side view of the air guide 114. Air in the upper feed channel 130 through the vents 196 blows air downward and toward the posts 116, 118 and 120 against the lining 98 which has been positioned in channel 130. Similarly, air in the lower feed channel 132 through the vents 198 blows air upward and toward the posts 116, 118 and 120 against facing 96 which has been placed in lower feed channel 132. Thus, the edges of the lining and facing at the seam are lined up against the guide posts 116, 118 and 120, thereby positioning the material 94 properly for sewing.

The electrical and pneumatic systems will now be described. It should be noted that components are designated by 200 numbers, electrical lines by 300 numbers and pneumatic lines by 400 numbers.

Figure 10:
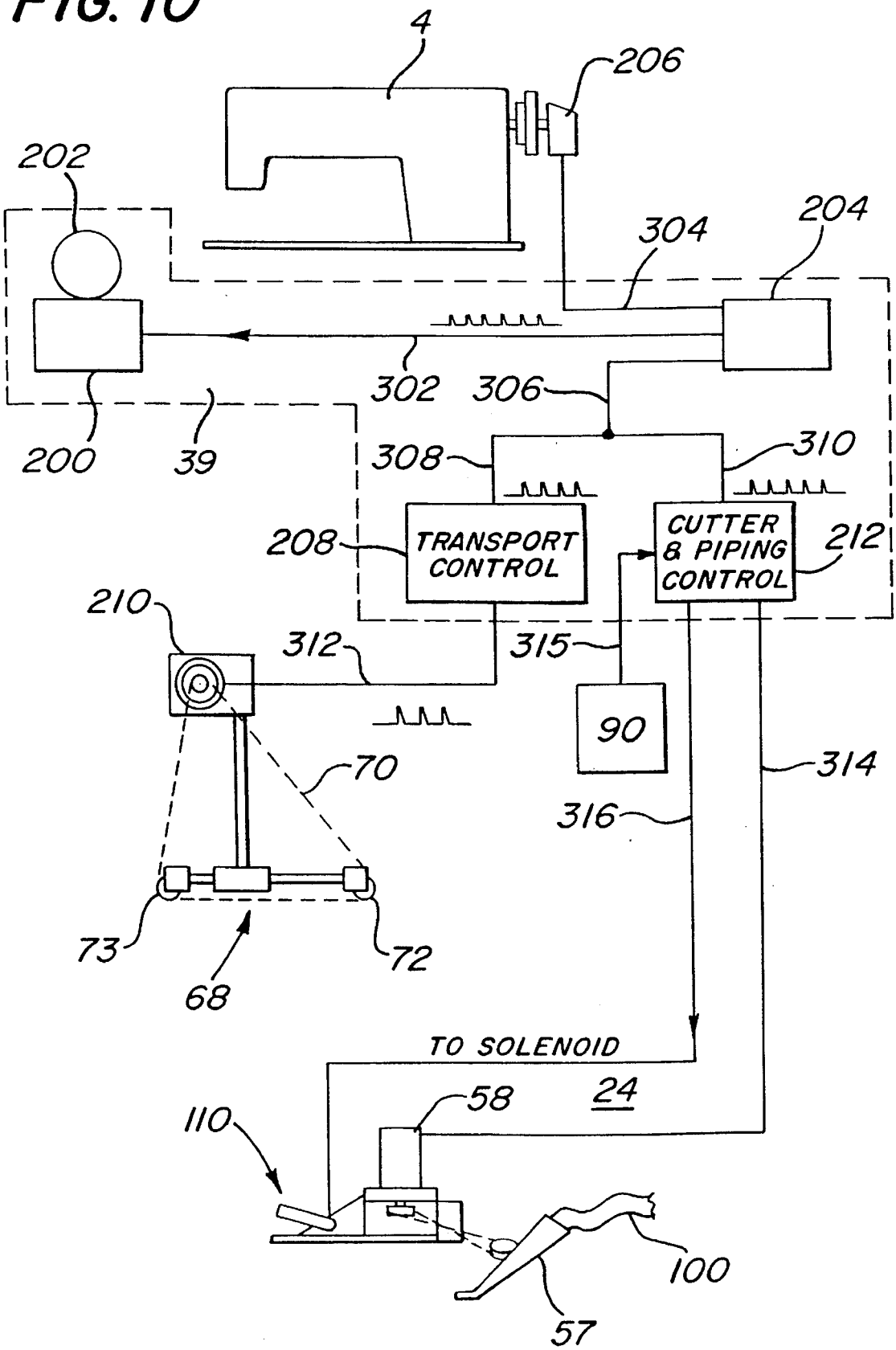
FIG. 10 is an electrical block diagram of the system.

The electrical connections between the various elements of the system are shown in FIG. 10. As can be seen in FIG. 4, the electronic controls and displays 39 comprise a control unit 200, an electronic clutch motor 202, an interface circuit 204, a transport controller 208 and a cutter and piping controller 212. These equipments are standard. The control unit 200 and the electronic clutch motor 202 are provided by EFKAof West Germany, EFKA stepper motor Model No. 6FA33 (202), control unit Model No. V231 (200). Also provided by EFKA is the material sensor Model No. 0010 (86). The interface circuit 204, the transporter controller 208 and the cutter and piping controller 212 are provided by Digitec located in Pennsylvania, United States of America, as the Genesis 2000 series system.

An encoder 206 is attached to the rotating wheel of the sewing machine head 4. The output of the encoder 206 on line 304 is connected to the interface circuits 204. Also connected to the interface circuits 204 is the control panel 200 via line 302. The pulse train from the encoder 206 on lines 302 enables the control unit 200 to keep the stitch count. The output of the interface circuitry 204 is also connected to the transporter controller 208 via lines 306 and 308. The transporter controller 208 accepts inputs from the encoder 206 which give the stitch count (i.e., one revolution per stitch) and converts it to a pulse train sent via lines 312 to the transporter stepper motor 210 which controls the speed of the stepper motor 210 so that the linear speed of the belt 70 equals the speed of the lower feed mechanism 9.

In addition, the output of the interface circuitry 204 via lines 306 and 310 is connected to the cutter and piping controller 212. The controller 212 generates a pulse train on line 314 which is connected to the stepper motor 58 for the positive feeding of the piping 100, thereby synchronizing the linear speed of the piping with the linear speed of the lower feed mechanism. The cutter and piping controller 212 receives a contact closure from the sensor 90 on line 315. It counts a predetermined number of stitches to allow the end of the material to be positioned under the cutter before operating the cutter mechanism 110 to cut the piping by sending a signal on line 316. In a similar fashion, the controller 212 inserts a delay prior to activating the cutter at the start of the stitching.

Figure 11:
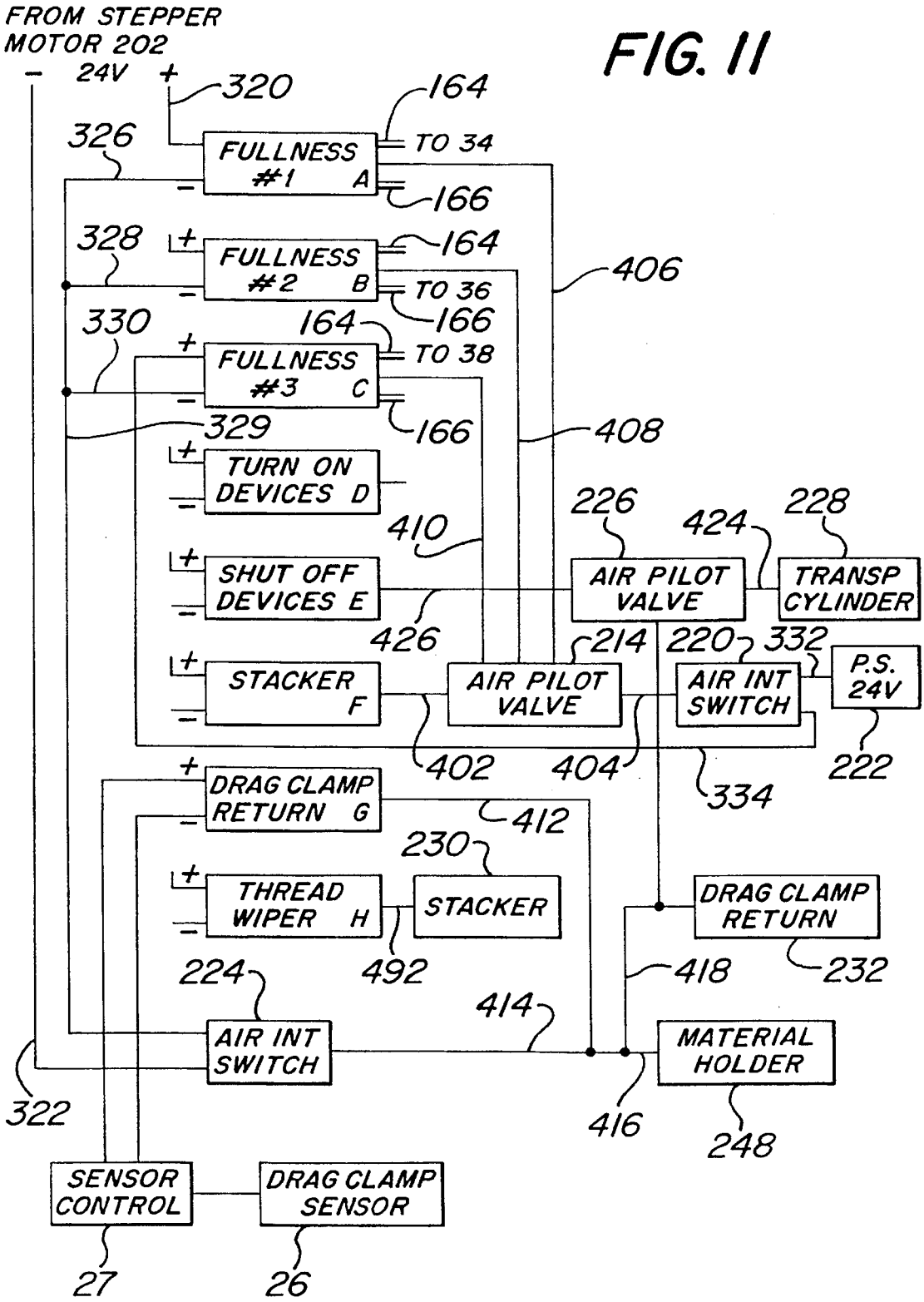
FIG. 11 is an electrical connection diagram of the various solenoids which operate the air cylinders performing the various functions automatically when the seam is being sewn.

FIG. 11 shows the various solenoids in the system used to control the compressed air flow to the various cylinders which operate automatically during the sewing of the seam. 24 Volts DC is provided from electronic clutch motor 202. As the electronic clutch motor 202 rotates through its positions, the voltage is applied to each of the solenoids A–H in turn. Thus, for solenoid A, the Fullness No. 1 solenoid, positive voltage is applied to operate the solenoid A when it is desired to obtain Fullness #1. The solenoids used are as follows:

| | |
|---|---|
| Solenoid A - | Fullness #1 |
| Solenoid B - | Fullness #2 |
| Solenoid C - | Fullness #3 |
| Solenoid D - | Turn On Devices - This solenoid is activated when a signal is received by the control unit 200 which signifies the completion of the initial back-tack stitches. |
| Solenoid E - | Shut Off Devices - This solenoid is operated when the sensor 86 detects the end of the material. |
| Solenoid F - | Stacker - Used to activate Fullness #3. |
| Solenoid G - | Drag Clamp Return. |
| Solenoid H - | Thread Wiper - Used to operate the stacker. |

As stated previously, the electronic clutch motor 202 is controlled by the control unit 200, which causes the stepper motor to rotate through various positions to apply 24 volt power to the solenoids in turn. Thus, when the control unit 200 sends a signal to the stepper motor to apply Fullness #1 to the seam, a positive voltage is applied to the Fullness #1 solenoid A via line 320. The negative return on line 322 to the fullness solenoids A, B and C, is connected through normally closed air interface switch 224. The output of the air interface switch 224 on lines 326, 328 and 330 are connected to solenoids A, B and C, respectively, to provide the return negative 24 Volts DC. As will be explained later, when the sewing of the seam is complete, the air interface switch 224 will be open which will remove the negative return to the fullness solenoids A, B and C to assure that the cylinders are fully retracted.

The application by the electronic clutch motor 202 of 24 Volts DC to the Fullness #1 solenoid A causes compressed air to be directed on air line 164 to cylinder 34 causing piston head 46 to be thrust forward against lever block 52, thereby imparting Fullness #1 to the seam as previously described. When the electronic clutch motor 202 removes the positive voltage from solenoid A, the compressed air output of solenoid A on air line 166 is directed to cylinder 34 to cause the piston head 46 to be retracted. Similarly, when the control unit 200 causes the electronic clutch motor 202 to move to apply positive voltage to the Fullness #2 solenoid B, compressed air is directed on air line 164 to thrust the piston head 48 forward against the lever block 52 to apply Fullness #2 to the seam. Again, under command of the control unit 200, when the electronic clutch motor 202 moves, removing the positive voltage from the Fullness #2 solenoid B, compressed air on air line 166 to cylinder 36 causes piston head 48 to retract, thereby removing Fullness #2 from the seam.

With regard to the application of Fullness #3, because the electronic controls 29 only provide for two steady state applications of voltages which are used for the Fullness #1 solenoid A and Fullness #2 solenoid B, there is only a pulse voltage available for Fullness #3. Therefore, the voltage normally used to operate the stacker, solenoid F, is used. When the pulse voltage is applied to solenoid F, compressed air is directed on air line 402 to an air pilot valve 214. The air pilot valve 214 opens, providing compressed air to air interface microswitch 220 on air line 404. The air interface microswitch 220 is connected to a 24 volt power supply 222 via line 332. When the air interface microswitch 220 is closed, positive 24 Volts DC is applied to the Fullness #3 solenoid C via line 334. Applying the input voltage to the Fullness #3 solenoid C operates the solenoid C which provides compressed air to air line 164. The air line 164 is connected to cylinder 38. The air input causes the piston head 50 to thrust forward against lever block 52, thereby applying Fullness #3 to the seam. The air pilot valve 214 is locked into its open position until it is released.

To assure that the Fullness #3 is not operative when the control unit 200 applies voltage to Fullness #1 solenoid A, the solenoid A directs compressed air via air line 406 to close the air pilot valve 214. Similarly, when the control unit 200 applies voltage to the Fullness #2 solenoid B, the solenoid B provides air on air line 408, to release the pilot valve 214. Also, when the air interface switch 224 is opened and the return negative voltage is removed from the Fullness #3 solenoid, compressed air is also applied on air line 410 to open air pilot valve 214.

The operation of the drag clamp sensor 26 and the drag clamp sensor control 27 will now be explained. When the drag clamp sensor 26 detects the end of the drag clamp travel, the drag clamp sensor control 27 applies voltage to the Drag Clamp Return solenoid G. The solenoid G applies compressed air via air line 412 to open air interface switch 224 which interrupts the negative voltage to the fullness solenoids A, B and C, thereby assuring that the piston heads 46, 48 and 50 are returned to their initial position and that the fullnesses have been removed.

In addition, the Drag Clamp Return solenoid G performs three other functions. It provides compressed air on air lines 412 and 416 to cause the material holder 74 to move into its operating position and to apply a stream of compressed air to the material being sewn to keep the material in proper position after the drag clamp has been released. The solenoid G also provides compressed air on air lines 412,418 and 420 to operate a solenoid (not shown) which activates a pulley system with cords attached to the drag clamp to return the drag clamp to its initial position. Finally, solenoid G applies compressed air via air lines 412 and 404 to air pilot valve 226 which provides compressed air to the transport cylinder 228 lowering the transporter 68 so that the transporter belt 70 can move the material after it has passed the upper and lower feeds 10 and 9, respectively, to the stacker.

Because the signal to operate the stacker through solenoid F has been used, the thread wiper signal, solenoid H, is used to operate the stacker 230. The Turn On Devices solenoid D and the Shut Off Devices solenoid E are standard with the equipment. For example, the Turn On Devices solenoid D turns on the air table which is standard with the machine, and operates and moves the air guide, as will be discussed later.

The machine automatically provides back-tack stitching at the beginning and at the end of the seam to prevent seam unravelling. Typically, at the start and at the end of the seam, three forward stitches and three back-tack stitches are made. It is the back-tack signal which causes the electronic clutch motor 202 to apply voltage to the Turn On Devices solenoid D.

In addition to the functions normally provided by the Shut Off Devices solenoid E, the solenoid E provides compressed air on air line 426 to open air pilot valve 226, thereby releasing transporter cylinder 228 and placing the transporter 68 in its starting position so that its belt does not contact the material.

Figure 12:
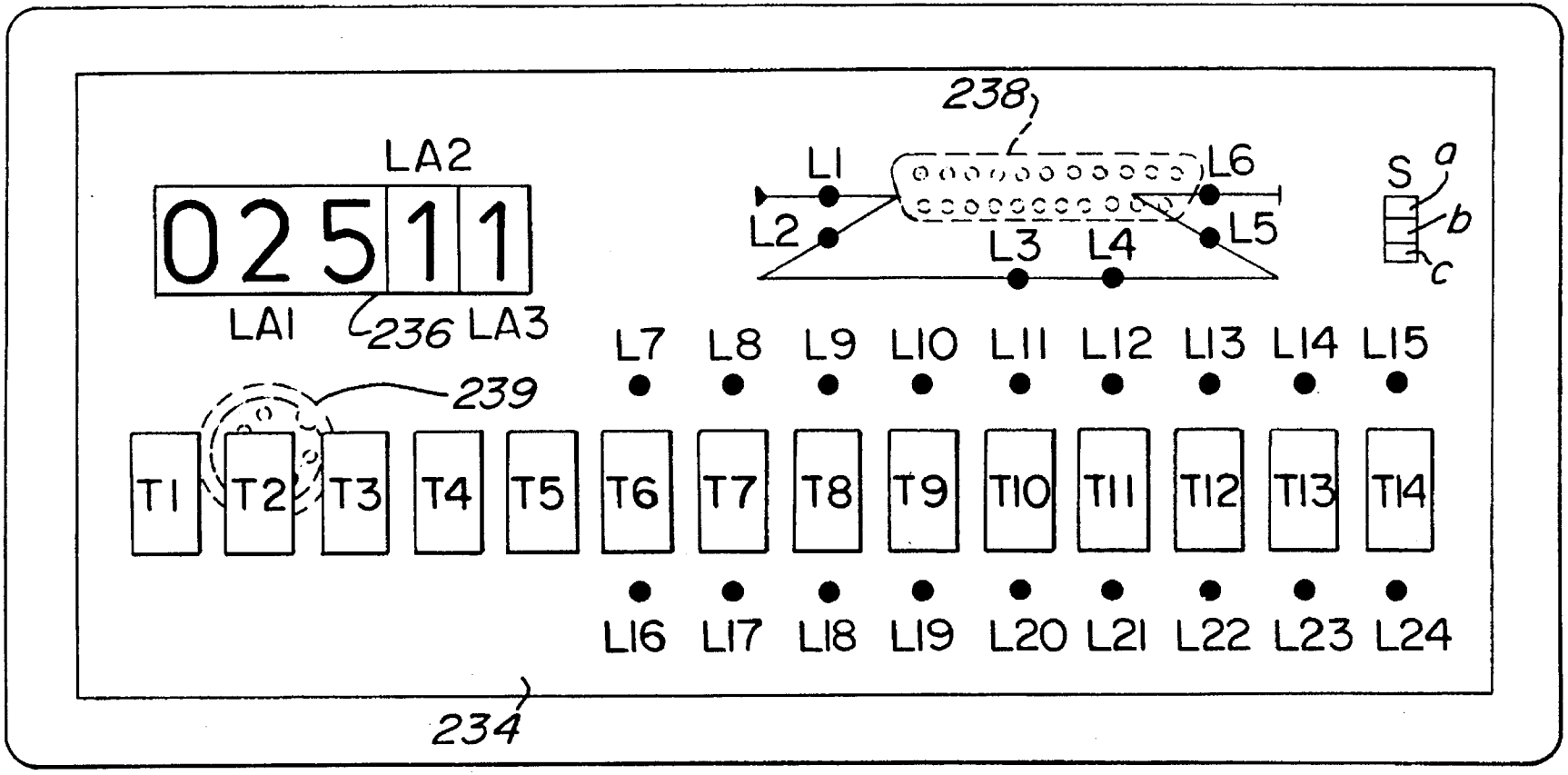
FIG. 12 is a front view-of the control panel and display which controls the system.

The system is set up and controlled by the control unit 200. The front panel 234, with the controls and displays of the control unit 200, is shown in FIG. 12. The control unit 200 is capable of storing and operating three programs and controlling the stitch count and fullnesses of up to seven segments of the seam. The stitch counts are entered by depressing button T1 which decreases the stitch count, or button T2 which increases the stitch count. The stitch count is displayed as LA1 in display 236.

The button T3 is used to choose any one of the three programs 1, 2 or 3, with the number of the program displayed as LA2. T4 is used to select which of the stitch segments is to be programmed. By successively pressing T4, the segment numbers 1–7 appear in turn on the display 236.

Button T5 operates the LEDs L1–L6, in turn, which represent the application of specific functions to the sewing cycle, as will be described later.

Button T6 selects either the functions represented by the upper bank of LEDs L7–15, or the functions represented by the lower bank of LEDs L16–24. For example, to apply Fullness #1 to segment 2 of program 1, buttons T3 and T4 are used to select the program number and the segment, and T6 is depressed to enable the lower bank of LEDs. T10 is then depressed lighting up LED L20. The stitch count for the segment is then set in using buttons T1 and T2 and is displayed at LA1. To apply Fullness #1 for 35 stitches of segment number 2, buttons T1 and T2 are depressed until 35 appears under LA1.

For Fullness #2, the segment is first selected using button T4, and then T11 is depressed, lighting LED L21. The stitch count for segment #2 is then entered using buttons T1 and T2. For Fullness #3, the button T8 is depressed, lighting LED L18. The other controls are used in a standard fashion to provide the stacker signal, the thread trimmer signal, the foot lift and so forth, which are standard with the machine.

Initial forward and back-tacking is entered into the system by first selecting program 1 using the T3 button and then depressing T6 to activate the upper set of LEDs L1–L15. T8 is then depressed to light L9. Button T5 is depressed to light L1. The number of forward stitches is then set in to LA1 using buttons T1 and T2. The back-tack stitches are set in by depressing T5 to light up L2 and then using buttons T1 and T2 to set up the number of back-tack stitches. Typically, three forward stitches and three back-tack stitches are used. The purpose of the back-tacking is to strengthen the stitches at both ends of the seam to prevent unravelling.

Similarly, after the other segments have been programmed, either for flat fullness (or slight positive or negative fullness as determined by the settings of the manual lever 14), the back-tacking at the end of the seam is entered by choosing the segment using the button T6, and depressing the button T12 to light up L13. T5 is then depressed in turn to light up L6 and L5 and the stitch count entered using the buttons T1 and T2 to enter the forward and back-tack stitching at the end of the seam.

By depressing button T9 to light L10, the stitching for each of the segments can be entered into the system. For example, after the initial forward and back-tacking has been entered, the remainder of segment 1 can be programmed by lighting L3 and L10 and putting in the stitch count for segment 1 into LA1. Either flat stitching or fullnesses 1, 2 or 3 can be entered into the segment as previously described. The fullness indicated by L18 is the maximum fullness, the fullness indicated by L20 is the intermediate fullness, and the fullness indicated by L21 is the minimum fullness. In this fashion, each of the segments in turn can be programmed with or without various degrees of fullness. In a typical situation, three to five segments are programmed, some of which are flat and some of which may have various types of fullness. The maximum Fullness #3 is required when the lining is a heavy, dark material, which necessitates greater fullness.

Button T11 is depressed to light L12 and T5 is depressed to light L4 to enable the system to use the material sensor 86. At the end of the last segment, L12 and L4 remain lit so that the sensor 86 is utilized. When the LED L4 is lit, the number of stitches to be inserted for the remainder of the seam after the sensor 86 has indicated the end of the material, is then entered in using T1 and T2. The thread wiper function is enabled when L14 is lit, to operate the stacker as has been previously described. L23 on the lower bank is activated to automatically switch from program 1 to the next program after the first program has been completed.

In the sewing of seams onto jackets, the facing and lining on the left side of the jacket is first sewn using program 1. The operator then inserts the facing and lining for the right side of the jacket and the control unit 200 automatically switches to program 2 for the right side of the jacket. L24 is not used by this system. L8 must be lit for every segment because it instructs the sewing machine to operate. L10 is an automatic speed setting which enables the machine to operate at a preset automatic speed. L15 results in automatic lifting of the foot at the end of the cycle. L17 is for reverse sewing at full speed which is not used in this system. L22 is used to raise the needle when the machine stops. This also is not used with this system.

The control unit 200 is, as stated previously, a standard device and most of the functions enabled by the control panel 234 are standard with the machine.

Also shown in the control panel is socket 238 which is mounted on the back of the control unit 200 for insertion of an EPROM which automatically programs the control unit. Also mounted on the back of the control unit 200 is socket 239 for plugging in the output of the material sensor 86.

The switch S1 is a three-position switch. In the first position "a", a program plugged into socket 238 is enabled. For manually overriding either the preset program or the program EPROM, the switch is placed in its center position "b". The setting up of programs manually is enabled by placing the switch S1 in its lower position "c".

Figure 13:
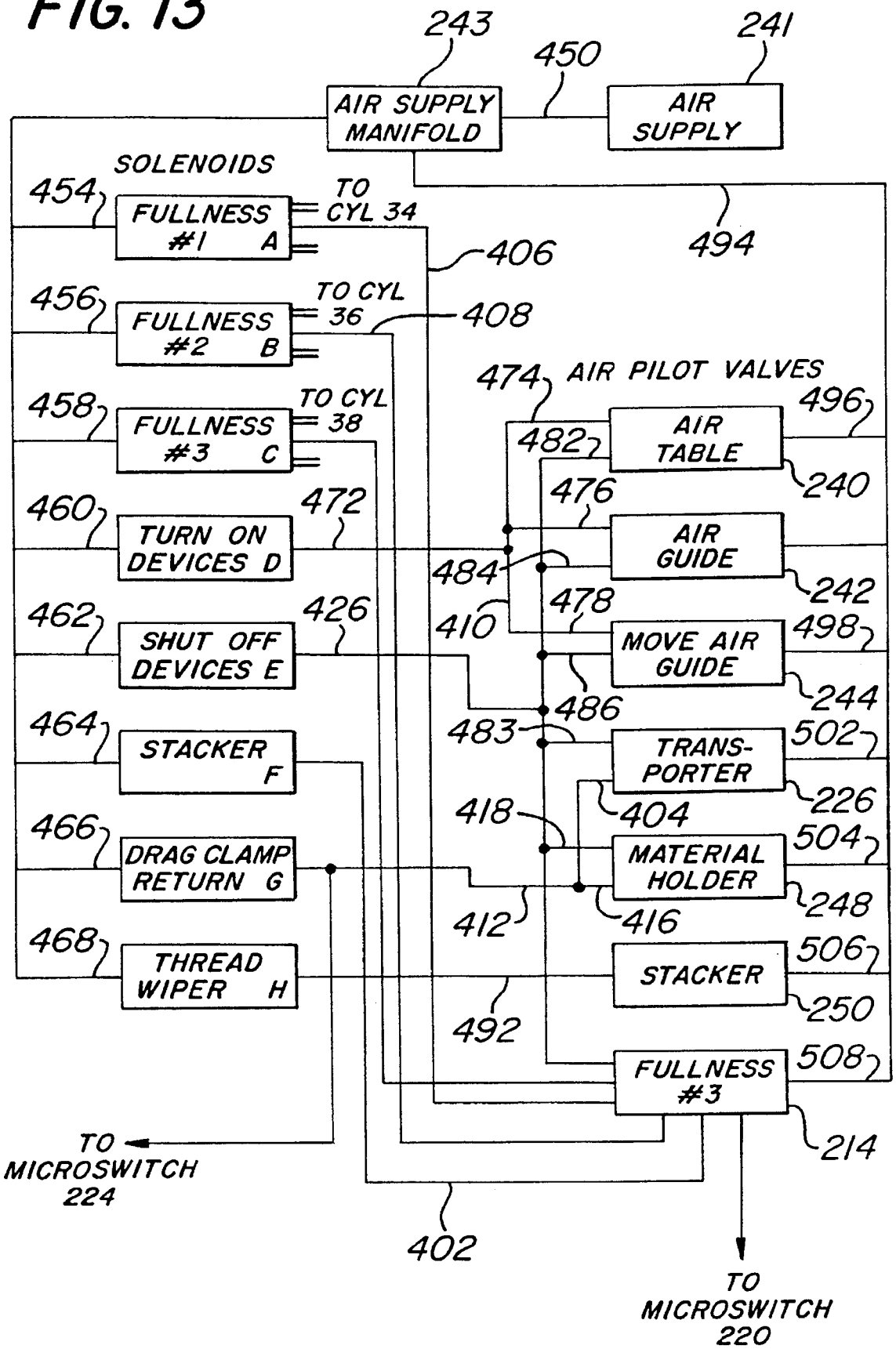
FIG. 13 is a block diagram of the hydraulic elements of the system.

The operation of the pneumatic system will now be explained using FIG. 13. An air supply 241 is provided by the facility where the sewing machine is used. The air supply 241 supplies pressurized air to an air supply manifold 243 via air line 450. The air supply manifold 242 provides air to the solenoids and the air pilot valves as shown. To provide air to the solenoids, an output of the air supply manifold 242 is connected via air line 452 and via air lines 454, 456, 458, 460, 462, 464, 466 and 468, to solenoids A–H, respectively. As previously described, the outputs of the solenoids A, B and C, for Fullnesses #1, #2 and #3, are connected to pneumatic cylinders 34, 36 and 38, respectively, to apply fullness to the seam. Also as previously described, the stacker solenoid F operates the air pilot valve 214 which is connected to the microswitch 214, providing 24 Volts DC to enable the Fullness #3 solenoid C. In addition, as discussed previously, fullness solenoids A and B also provide inputs to the air pilot valve 214 to assure that Fullness #3 is turned off when Fullnesses #1 and #2 are applied. Therefore, solenoid A is connected via air line 406 to air pilot valve 214 and solenoid B is connected via air line 408 to air pilot valve 214.

In addition, the Turn On Devices solenoid D, via air lines 472 and 474, 476 and 478, operates air valves 240, 242 and 244, respectively, to provide air to the air table, the air guide, and to move the air guide, respectively. Shut Off Devices solenoid E provides air to air line 426, and to air lines 482, 484 and 486, turn off the air pilot valves 240, 242 and 244, respectively, to turn off the air to the air table and air guide and to move the air guide to its initial rest position. Also, the Shut Off Devices solenoid E provides air to air line 426 and to air lines 483, 418, and 485, to cut off air pilot valves 226, 248, and 214, respectively, to reset the transporter and material holder to their initial positions and to cut off Fullness #3.

As previously stated, the stacker solenoid F via line 402 operates the Fullness #3 valve 214 which is then connected to microswitch 220 to apply power for the fullness solenoid C.

The Drag Clamp Return solenoid G provides air to line 412 and to lines 404 and 416 to operate air pilot valves 226 and 248 to move the transporter and the material holder into their operating positions. Finally, as stated previously, the thread wiper solenoid H via line 492 operates the air pilot valve 214 to activate the stacker.

The air supply for the air pilot valves is provided by an output from the air supply manifold 243 on air line 494 and 496, 498, 500, 502, 504, 506 and 508 to operate air pilot valves K–Q, respectively.

The Turn On Devices solenoid D is activated by the electronic clutch motor 202 upon the generation of the back-tack signal in the control unit 200. The Shut Off Devices solenoid E is activated by the electronic clutch motor 202 when the control unit 200 generates the foot lift signal at the end of the sewing cycle.

A sewing machine system for automating the sewing of linings into jackets has been described. The system automatically inserts fullness at predetermined segments of predetermined lengths in the seam, it positively feeds and automatically cuts piping when piping is sewn into the seam and it provides an automatic means for holding the material in place for the final stitches after the drag clamp has been released. Although in the embodiment disclosed herein a PFAFF sewing machine is shown, it should be kept in mind that any equivalent sewing machine head such as those produced by Durkopp or Brothers may be used.

The operator need only position the material in the drag clamp and in the air guide and press the foot pedal or other starting switch to operate the machine. The seam is sewn and the material is moved off the table and stacked automatically and rapidly.

In the sewing of the seams of the jackets, the left side is sewn first using the first program, program 1, set into the control unit 200. The operator then takes the material for the right side of the jacket and inserts it into the machine. The right side of the jacket is sewn in reverse order to the left side of the jacket under control of program 2 which has been inserted into the control unit 200. Thus, the control unit 200 automatically switches between program 1 and 2 as the left side and then the right side of the jacket is sewn to the lining.

The sewing machine of this invention increases the productivity of the operators two to three fold or greater, while at the same time standardizing and improving the quality of the seams. The sewing machine can be made of standard parts, for example, standard, off-the-shelf components and assemblies, or their equivalents. An exemplary listing of these standard parts is given below:

| ITEM | MODEL NO. | MANU-FACTURER | U.S. DISTRIBUTOR |
|---|---|---|---|
| Pilot valves | MPD 451<br>MPD 33 | Bachman-France | ALL AIR, N.Y.C. |
| Solenoids | S410<br>S310 | Humphery - Michigan | Airline Hydraulics, PA |
| Air Cylinders | S-10 | Festo, Germany | Airline Hydraulics, PA |
| | | Winco, Philadelphia | Humphery, PA |
| | | Yamato, North Carolina | Yamato, NC |
| Pfaff Sewing Machine | 487G | Pfaff, Germany | Pfaff, Germany |
| Durkopp Sewing Machine | 219-115-203 | Durkopp, Germany | Durkopp, Atlanta |
| Brother Sewing Machine | 794-905 | Brother, Japan | Brother, PA |
| Drag Clamp | 7184931 | Durkopp, Germany | Durkopp, Georgia |
| Air Guide | 003 | Pro-Feel, Italy | Pro-Feel, Georgia |
| Stacker | Rockway | A.C. Components, Pennsylvania | A.C. Components, PA |
| Cutter | 21CA221 | Digitec, Inc., Pennsylvania | Digitec, PA |
| Sensor (26) | E3C | Omeron, Japan | Airline Hydraulics, PA |
| Sensor (86) | E001 | EFKA, Germany | EFKA, Georgia |
| Sensor (90) | 21CP029 | Omeron, Japan | Digitec, PA |
| Motor (202) | 6FA33V | EFKA, Germany | EFKA, Georgia |
| Control Unit (200) | V231 | EFKA, Germany | EFKA, Georgia |

Without further elaboration, the foregoing will so fully illustrate my invention, that others may, by applying current or future knowledge, readily adapt the same for use under the various conditions of service.

I claim:

1. A sewing machine comprising a needle, a foot, means for feeding material past said needle, and means for holding said material in place as said material is being sewn, said means for holding said material in place comprising means for impinging a stream of compressed air onto said material and wherein said means for holding said material in place comprises a source of compressed air and a pneumatic cylinder having a piston and a piston head and wherein said compressed gas is compressed air and said means for holding said material in place further comprises a first air line connecting said source of compressed gas to said pneumatic cylinder, and a second air line connecting said source of compressed gas to said piston head, and wherein said piston head has an opening therein through which said compressed air flows to impinge on said material.

2. A system for sewing together a first piece of material to a second piece of material at a seam, each of said pieces of material having a leading edge and a trailing edge, said system comprising: a sewing machine positioned on a table and having a foot, a needle, a lower feed mechanism positioned beneath said foot for feeding said first piece of material past said needle, an upper feed mechanism positioned above said foot for feeding said second piece of material past said needle; mechanical means for holding said pieces of material in place; and pneumatic means for holding said pieces of material in place, said pneumatic holding means comprising means for impinging a stream of compressed gas onto said materials; and an electronic control means for controlling the operation of said sewing machine and wherein said means for holding said pieces of material in place comprises a source of compressed gas and a pneumatic cylinder having a piston with a piston head and wherein said compressed gas is compressed air and said means for holding said pieces of material in place further comprises a first air line connecting said source of compressed gas to said pneumatic cylinder, and a second air line connecting said source of compressed gas to said piston head, and wherein said piston head has an opening therein through which said compressed air flows to impinge on said pieces of material.

3. The system of claim 2 further comprising a first sensor having an electric eye and a reflector mounted on said table, and wherein said mechanical holding means comprises a drag clamp assembly having a blocking tab mounted on said drag clamp assembly, said electric eye providing a first signal to said electronic control means when said passes under said electric eye blocking tab.

4. The system of claim 3 wherein said electronic control means provides a second signal, responsive to said first signal, for activating said means for impinging a stream of compressed air on said materials.

5. The system of claim 4 wherein said drag clamp assembly is positioned at an initial starting position and moves to a forward position and said system further comprises means for automatically returning said drag clamp assembly from said forward position to said initial starting position, said means comprising a third signal provided by said electronic control means.

6. The system of claim 5 wherein said means for automatically returning said drag clamp assembly to its initial position from said forward position further comprises a cylinder responsive to said third signal, a pulley attached to said cylinder and a cord attached to said drag clamp assembly and to said pulley.

7. The system of claim 2 further comprising means for inserting piping into said seam, said means for inserting piping into said seam comprising means for positively feeding said piping into said seam.

8. The system of claim 7 wherein said means for inserting piping into said seam comprises a chute into which said piping is placed, said chute comprising a feed segment, a folding segment and an end segment positioned adjacent said lower feed mechanism.

9. The system of claim 8 wherein said means for positively feeding said piping into said seam further comprises a motor driving a pulley system and a pulley belt, said motor rotating at a speed responsive to signals from said electronic control means, said pulley belt being positioned to contact said piping in said chute and positively feed said piping, said motor speed being at a rate to equalize the linear speed of said piping with the linear speed of said lower feed mechanism.

10. The system of claim 9 wherein said seam has a beginning and an end, and said system further comprising means responsive to said electronic control means for automatically cutting said piping at the beginning and at the end of said seam.

11. The system of claim 10 wherein said means for automatically cutting said piping comprises a cutter and a sensor and said sensor provides first signals to said electronic control means when said sensor detects said leading edge of said materials and said trailing edge of said materials.

12. The system of claim 11 wherein said electronic control means comprises means for accepting said first signals and means for providing second signals to said cutting means a predetermined delay time after receipt of said first signals.

13. The system of claim 3 wherein said seam comprises a plurality of segments and said system comprises means for automatically inserting a plurality of fullnesses into said seam comprising a plurality of pneumatic cylinders, one of said pneumatic cylinders for each of said plurality of fullnesses, respectively, and wherein said electronic control means comprises means for defining the number of stitches in each of said segments and for inserting any one of said fullnesses into any of said segments.

14. The system of claim 13 wherein each of said plurality of pneumatic cylinders comprises a piston, a piston head, and a piston extension, and said means for inserting said plurality of fullnesses comprises a lever block positioned opposite said piston head, a moveable lever, and a linkage system responsive to the movement of said lever, said linkage system being connected to said upper feed mechanism.

15. The system of claim 14 wherein each of said cylinders further comprises means to limit the motion of said piston and piston head comprising a limit stop positioned on said piston extension.

16. The system of claim 15 wherein said compressed gas comprises compressed air and said means for automatically inserting said plurality of fullnesses further comprises a first and a second air line connected to each of said pneumatic cylinders, and means responsive to an electrical signal provided by said electronic control means, for inserting said compressed air into said first air line to thrust said piston head forward against said lever block to move said forward lever block from an initial rest position and for inserting said compressed air into said second air line to reset said piston head back to said initial rest position.

17. The system of claim 16 wherein each of said pistons has an initial rest position further comprising means for automatically resetting each of said pistons to its initial rest position after said seam has been sewn.

18. A system for sewing together a first piece of material to a second piece of material at a seam, each of said pieces of material having a leading edge and a trailing edge, said system comprising: a sewing machine positioned on a table and having a foot, a needle, a lower feed mechanism positioned beneath said foot for feeding said first piece of material past said needle, an upper feed mechanism positioned above said foot for feeding said second piece of material past said needle; means for inserting piping comprising a chute, means for positively feeding said piping into said seam, and electronic control means for controlling the operation of said sewing machine, said chute having a slot therein, and wherein said chute comprises a feed segment and an end segment positioned adjacent said lower feed mechanism, and wherein said means for positively feeding said piping into said seam further comprises a motor driving a pulley and a pulley belt, said motor rotating at a speed responsive to signals provided by said electronic control, said pulley belt being positioned to contact said piping in said chute through said slot in said chute to positively feed said piping.

19. The system of claim 18 wherein said seam has a beginning and an end, said system further comprising means responsive to said electronic control means for automatically cutting said piping at the beginning and at the end of said seam.

20. The system of claim 19 wherein said means for automatically cutting said piping comprises a cutter and a sensor and said sensor provides first signals to said electronic control means when said sensor detects said leading edge of said materials and said trailing edge of said materials.

21. The system of claim 20 wherein said electronic control means comprises means for accepting said first signals and means for providing second signals to said cutting means a predetermined delay time after receipt of said first signals.

22. The system of claim 18 wherein said seam comprises a plurality of segments and said system comprises means for automatically inserting a plurality of fullnesses into said seam comprising a source of compressed gas, a plurality of pneumatic cylinders, one of said pneumatic cylinders for each of said plurality of fullnesses, respectively, and wherein said electronic control means comprises means for defining the number of stitches in each of said segments and for inserting any one of said fullnesses into any of said segments.

23. The system of claim 22 wherein each of said plurality of pneumatic cylinders comprises a piston, a piston head, and a piston extension, and said means for inserting said plurality of fullnesses comprises a lever block positioned opposite said piston head, a moveable lever, and a linkage system responsive to the movement of said lever, said linkage system being connected to said upper feed mechanism.

24. The system of claim 23 wherein each of said cylinders further comprises means to limit the motion of said piston and piston head comprising a limit stop positioned on said piston extension.

25. The system of claim 24 wherein said compressed gas comprises compressed air and said means for automatically inserting said plurality of fullnesses further comprises a first and a second air line connected to each of said pneumatic cylinders, and means, responsive to an electrical signal provided by said electronic control means, for inserting said compressed air into said first air line to thrust said piston head forward against said lever block to move said lever block from an initial rest position and for inserting said compressed air into said second air line to reset said piston head back to said initial rest position.

26. The system of claim 25 further comprising means for automatically resetting each of said pistons to its initial rest position after said seam has been sewn.

27. The system of claim 18 further comprising a drag clamp assembly, means for moving said drag clamp from an initial starting position towards said sewing machine, means for automatically releasing said first and second piece of material from said drag clamp assembly, and means for holding said pieces of material in place after said material has been released, said holding means comprising a means for impinging a stream of compressed gas on said materials.

28. The system of claim 27 wherein said means for holding said pieces of material in place comprises a source of compressed gas and a pneumatic cylinder having a piston with a piston head.

29. The system of claim 28 wherein said compressed gas is compressed air and said means for holding said pieces of material in place further comprises a first air line connecting said source of compressed gas to said gas cylinder, and a second air line connecting said source of compressed gas to said piston head, and wherein said piston head has an opening therein through which said compressed air flows to impinge on said pieces of material.

30. The system of claim 29 further comprising a first sensor having an electric eye and a reflector mounted on said table, and said drag clamp assembly comprises a blocking tab mounted on said drag clamp assembly, said electric eye providing a first signal to said electronic control means when said blocking tab passes under said electric eye.

31. The system of claim 30 wherein said electronic control means provides a second signal responsive to said first signal for activating said means for impinging a stream of compressed air on said materials.

32. The system of claim 31 further comprising means for automatically returning said drag clamp assembly to its initial starting position, said means comprising a third signal provided by said electronic control means.

33. The system of claim 32 wherein said means for automatically returning said drag clamp assembly to its initial position further comprises a cylinder responsive to said third signal, a pulley attached to said cylinder and a cord attached to said drag clamp assembly and to said pulley.

34. A system for sewing together a first piece of material to a second piece of material at a seam, each of said pieces of material having a leading edge and a trailing edge, said seam comprising a plurality of segments, and said system comprising: a sewing machine positioned on a table and having a foot, a needle, a lower feed mechanism positioned beneath said foot for feeding said first piece of material past said needle, an upper feed mechanism positioned above said foot for feeding said second piece of material past said needle; electronic control means for controlling the operation of said sewing machine; and means for automatically inserting a plurality of fullnesses into said seam comprising a source of compressed gas, a plurality of pneumatic cylinders, one of said pneumatic cylinders for each of said plurality of fullnesses, respectively, each of said pneumatic cylinders comprising a piston, and a piston head, and wherein said electronic control means comprises means for defining the number of stitches in each of said segments and for inserting any one of said fullnesses into any of said segments.

35. The system of claim 34 wherein each of said plurality of pneumatic cylinders comprises a piston extension connected to said piston, and said means for inserting said plurality of fullnesses comprises a lever block positioned opposite said piston head, a moveable lever, and a linkage system responsive to the movement of said lever, said linkage system being connected to said upper feed mechanism.

36. The system of claim 35 wherein each of said cylinders further comprises means to limit the motion of said piston and piston head comprising a limit stop positioned on said piston extension.

37. The system of claim 36 wherein said compressed gas comprises compressed air and said means for automatically inserting said plurality of fullnesses further comprises a first and a second air line connected to each of said pneumatic cylinders, and means, responsive to an electrical signal provided by said electronic control means, for inserting said compressed into said first air line to thrust said piston head forward against said lever block to move said lever block from an initial rest position air into said second air line to reset said piston head back to said initial reset position.

38. The system of claim 37 further comprising means for automatically resetting each of said pistons to its initial rest position after said seam has been sewn.

39. The system of claim 34 further comprising means for inserting piping into said seam said means for inserting piping into said seam comprising means for positively feeding said piping into said seam.

40. The system of claim 39 wherein said means for inserting piping into said seam comprises a chute into which said piping is placed, said chute comprising a feed segment, a folding segment and an end segment positioned adjacent said lower feed mechanism.

41. The system of claim 40 wherein said means for positively feeding said piping into said seam further comprises a motor driving a pulley system and a pulley belt, said motor rotating at a speed responsive to signals from said electronic control means, said pulley belt being positioned to contact said piping in said chute and to positively feed said piping.

42. The system of claim 41 further comprising means responsive to said electronic control means for automatically cutting said piping at the beginning and at the end of said seam.

43. The system of claim 42 wherein said means for automatically cutting said piping comprises a cutter and a sensor and said sensor provides first signals to said electronic control means when said sensor detects said leading edge of said materials and said trailing edge of said materials.

44. The system of claim 43 wherein said electronic control means comprises means for accepting said first signals, and means for providing second signals to said cutting means a predetermined delay time after receipt of said first signals.

45. The system of claim 34 further comprising a drag clamp assembly, means for moving said drag clamp assembly from an initial starting position towards said sewing machine, means for automatically releasing said drag clamp, and means for holding said pieces of material in place after said drag clamp has been released, said holding means comprising a means for impinging a stream of compressed gas on said materials.

46. The system of claim 45 wherein said means for holding said pieces of material in place comprises a source of compressed gas and a pneumatic cylinder having a piston with a piston head.

47. The system of claim 46 wherein said compressed gas is compressed air and said means for holding said pieces of material in place further comprises a first air line connecting said source of compressed gas to said gas cylinder, and a second air line connecting said source of compressed gas to said piston head, and wherein said piston head has an opening therein through which said compressed air flows to impinge on said pieces of material.

48. The system of claim 47 further comprising a first sensor having an electric eye and a reflector mounted on said table, and said drag clamp assembly comprises a blocking tab mounted on said drag clamp assembly, said electric eye providing a first signal to said electronic control means when said blocking tab passes under said electric eye.

49. The system of claim 48 wherein said electronic control means provides a second signal responsive to said first signal for activating said means for impinging a stream of compressed air on said materials.

50. The system of claim 49 further comprising means for automatically returning said drag clamp assembly to its initial starting position, said means comprising a third signal provided by said electronic control means.

51. The system of claim 50 wherein said means for automatically returning said drag clamp assembly to its initial position further comprises a cylinder responsive to said third signal, a pulley attached to said cylinder and a cord attached to said drag clamp assembly and to said pulley.

* * * * *